US005803540A

United States Patent [19]

Schwartz

[11] Patent Number: 5,803,540

[45] Date of Patent: Sep. 8, 1998

[54] STACKABLE ARM CHAIR

[75] Inventor: Larry Schwartz, Franklin Lakes, N.J.

[73] Assignee: Sun Isle Casual Furniture, LLC, Franklin Lakes, N.J.

[21] Appl. No.: 846,368

[22] Filed: Apr. 30, 1997

Related U.S. Application Data

[63] Continuation-in-part of Ser. No. 697,464, Aug. 26, 1996, Pat. No. 5,704,690.

[51] Int. Cl.[6] ..... A47C 3/04

[52] U.S. Cl. ..... 297/239; 297/451.9

[58] Field of Search ..... 297/239, 451.9, 297/411.41, 446.1

[56] References Cited

U.S. PATENT DOCUMENTS

| | | | |
|---|---|---|---|
| D. 355,985 | 3/1995 | Karten et al. . | |
| D. 374,129 | 10/1996 | Timmons . | |
| 2,806,515 | 9/1957 | Burst | 297/451.1 |
| 2,997,339 | 8/1961 | Wilson . | |
| 3,053,493 | 9/1962 | Stafford . | |
| 3,338,591 | 8/1967 | Rowland . | |
| 4,341,419 | 7/1982 | Sebel | 297/239 |
| 5,044,691 | 9/1991 | Guichon . | |
| 5,088,792 | 2/1992 | Guichon | 297/239 X |
| 5,383,712 | 1/1995 | Perry . | |
| 5,524,963 | 6/1996 | Barile . | |

FOREIGN PATENT DOCUMENTS

| | | | |
|---|---|---|---|
| 1161951 | 9/1958 | France | 297/239 |
| 2586916 | 3/1987 | France | 297/239 |
| 87/05787 | 10/1987 | WIPO | 297/239 |

*Primary Examiner*—Peter R. Brown

*Attorney, Agent, or Firm*—Lerner, David, Littenberg, Krumholz & Mentlik

[57] ABSTRACT

A stackable arm chair is constructed from the combination of a frame which supports woven material to form the chair's seat, back and side arm portions. Openings provided in the side arm portions enable passage of the rear legs of an adjacent arm chair to provide a nested forward stack occupying a minimum of volume. The openings are configured and dimensioned so as to cooperate with a conventional cushion to block the openings from view thereby eliminating the conventional stackable chair appearance.

35 Claims, 21 Drawing Sheets

STACKABLE ARM CHAIR

This application is a continuation-in-part of application Ser. No. 08/697,464 filed on Aug. 26, 1996, now U.S. Pat. No. 5,704,690.

BACKGROUND OF THE INVENTION

The present invention relates in general to stackable furniture, and more specifically, to stackable arm chairs having removable seat cushions, the chairs constructed from synthetic yarns of polymer material having a natural wicker appearance which are suitable for use in a variety of environments such as outdoors. The yarns and weaves of the present invention are also disclosed in Applicant's pending Design application Ser. No. 056,425, filed on Jun. 28, 1996.

Natural wicker has been used in the manufacture of furniture, baskets and other articles for many centuries. Natural wicker articles are manufactured from the twigs or branches of various plants that are first soaked in water in order to make them pliable, then woven to form into the article and finally allowed to dry. Furniture manufactured from wicker offers greater comfort than furniture manufactured from other materials because of wicker's inherent compliancy. Further, wicker is light weight and reasonably strong, making it an important material in the manufacture of furniture.

In recent years, the popularity of wicker furniture has increased significantly. The casual, informal appearance of wicker has made it especially popular for use in enclosed porches and other informal settings in homes, hotels and other establishments. Natural wicker, however, has had limited use in the outdoor furniture market, including patio furniture, pool furniture and the like. This is because natural wicker softens and weakens when wet, and is more susceptible to rotting and mildew than many other natural and man-made furniture materials. Further, natural wicker furniture is expensive because of the cost of the raw natural wicker which must be harvested and treated. The cost of natural wicker furniture is also increased by the added step of moistening the wicker before weaving it into furniture.

Woven wicker typically comprises a warp yarn, i.e., a yarn running straight through the woven material and providing support, and a weft yarn, i.e., a yarn used as filler that is woven around the warp yarn. Numerous styles of weave are used in the manufacture of wicker furniture. The various styles of weave result in a different look, feel, strength and weight of the finished woven product. In a simple weave pattern, the warp yarns are spaced apart and arranged parallel to each other. The weft yarns are woven over and under alternating warp yarns. Adjacent weft yarns pass on opposite sides of a given warp yarn. Variations of this pattern, such as passing the weft yarn over two adjacent warp yarns, are known in the art.

Wicker is additionally used in the manufacture of furniture by covering structural members such as legs and arms by wrapping. Further, decorative open patterns may be incorporated into an article of furniture between the panels of woven material and the structural members.

A primary reason for the popularity of wicker is its unique, natural look. Inherent imperfections in the natural plant material used in manufacturing wicker furniture create random changes in coloration and texture across the surface of a given woven panel. The imperfections may reflect light differently from the surrounding areas of wicker, or may appear as local changes in color or hue within a woven wicker panel. The small nicks and knots present in a natural wicker yarn further create a unique, mildly rough "feel" to wicker.

Other materials have been used in the manufacture of wicker-like furniture. For example, metallic wire has been wrapped in natural rush or paper and woven to simulate natural wicker furniture. Like natural wicker furniture, furniture made in this manner may not be used in outdoor environments. In addition, the wrapping tends to tear and wear away from the wire, causing unsightly defects.

Polymer yarns have also been used to manufacture wicker-like furniture. In one example of a polymer yarn, a polyester filament cord is coated with a polyvinyl chloride (PVC) coating. Wicker-like furniture manufactured from such polymer yarns has been found to be strong, wear-resistant and relatively inexpensive. In addition, polymer wicker chairs may be used outdoors because the yarn is resistant to the effects of water and the environment. Wicker-like furniture manufactured from a smooth, monochrome polymer yarn, however, has an artificial look and feel. A woven panel of such furniture has a uniform, uninterrupted color and reflects light without variation across its surface. It is immediately evident that furniture manufactured from such yarn has been made from man-made materials, and the furniture has, in general, a "plastic" look. In addition, such panels have a smooth, silky feel, unlike the slightly roughened feel of natural wicker.

In order to overcome these deficiencies in synthetic yarns, a longitudinal color stripe has been added to the outside surface of a polymer yarn in order to give furniture manufactured from that yarn a more natural look. The stripe imparts a variation of color on the surface of a material woven from that yarn. The material, however, remains smooth and silky to the touch, unlike natural wicker and hence, still retained much of its "plastic" look.

In another example in order to impart a more natural feel to a panel woven from a polymer yarn, raised points have been formed on the outside surface of the polymer yarn, giving it a star-shaped cross section. Such raised points interrupt the light reflection by the yarn, decreasing the artificial look of a smooth yarn surface. The raised points, however, form a very rough surface on the woven material, making it uncomfortable and likely to catch delicate clothing. The surface color of the polymer yarn may have a motley look in different hues. In sum, no adequate yarn material has been suggested for the manufacture of a wicker-like article of furniture that has the look and texture or feel of natural wicker, but is durable and may be used in a variety of environments such as an outdoor setting.

Furniture such as chairs are often shipped from the manufacturer or distributor to the retail store and/or to the ultimate consumer in protective cardboard boxes. In the absence of the ability to stack these chairs, each chair would necessitate its storage in its own container. As a result, substantially increased storage space at warehouses, as well as truck space during shipping is required for these chairs. It would therefore be highly desirable to be able to stack a plurality of chairs into a single nested stack which would occupy approximately the same floor space as a container having a single chair therein. To this end, there is known a number of chairs which are stackable. For example, stackable chairs are disclosed in Rowland, U.S. Pat. No. 3,338,591; Wilson, U.S. Pat. No. 2,997,339; Barile, U.S. Pat. No. 5,524,963; Stafford, U.S. Pat. No. 3,053,493; Perry, U.S. Pat. No. 5,383,722; and Timmons, U.S. Pat. No. 374,129. Each of the aforementioned patents disclose stackable chairs which are specifically constructed without arm rests.

Chairs which have arm rests are desirable for many applications since the sidearms reduce fatigue of the person sitting in the chair and therefore increase the ability of the sitter to concentrate. In addition, certain chair designs lend themselves more suitable for those having arm rests, such as chairs having a wicker look. Accordingly, chairs having arm rests are desirable for many uses, for example, indoor and outdoor furniture where a particular look or style is desired, as well as to provide additional sitting comfort. However, in general, chairs having arm rests do not typically provide stackability because the arm rests interfere with the stacking arrangement and/or increase the stack height of the chairs to render stacking undesirable. There is known from Guichon, U.S. Pat. No. 5,044,691 and Sebel, U.S. Pat. No. 4,441,419 stackable chairs having armrests. In Sebel, the legs are formed with outwardly directed channels, the forward edge portion of each rear leg and the rearward edge portion of each front leg being extended upwardly beyond the seat to form rearward and forward portions of the corresponding arm rests. This construction allows the legs from adjacent chairs to be received within the outwardly directed channels to enable stacking of the chairs. However, this construction severely limits the ability to create stackable arm chairs of various designs. In Guichon, the front and rear legs are similarly constructed, with the rear legs passing through notched sections of the seat which communicate with the rear leg channels.

It has been found desirable to provide arm chairs with side panels which are substantially closed to create a pleasing appearance. To this end, there are known stackable arm chairs of the aforementioned type in which a relatively large opening is provided in the side panels to allow passage of the rear legs of another chair to accommodate stacking. However, because of the large size of these openings, such openings often detract from the aesthetic appearance of the chair. Although these stackable chairs may include a removable seat cushion, the thickness of the standard cushion is relatively small in comparison to the size of the opening. Thus, with or without a seat cushion, the enlarged openings in the side panels detract from the aesthetic appearance of the chair. In sum, there is unknown a stackable arm chair which is aesthetically pleasing, while at the same time allowing a greater degree of design flexibility than provided by the prior art stackable arm chairs and which provides greater consumer acceptance.

SUMMARY OF THE INVENTION

It is therefore broadly an object of the present invention to provide an arm chair which is suitable for stacking while providing an aesthetically pleasing appearance.

Another object of the present invention is to provide a stackable arm chair which retains versatility of design.

A yarn of indeterminate length is disclosed having a wicker look suitable to be woven into wicker-like articles such as the aforementioned stackable arm chairs and the like. In accordance with one embodiment, the yarn has an inner core and an outer coating having an outer surface. At least one groove is formed in the outer surface extending substantially in an axial direction on the yarn. The groove may vary in position around the circumference of the yarn, and may be interrupted in an axial direction along the yarn. The groove may furthermore have a generally rectangular, curved or other cross sectional shape.

The yarn additionally has a visual representation of a stripe of a color or visual appearance other than the color or appearance of the outer surface of the yarn, extending substantially in an axial direction along the yarn. The stripe may vary in position around the circumference of the yarn. Further, the stripe may be located within the groove, or may intersect the groove. The relative circumferential position of the groove and the stripe may vary at different axial positions along the yarn. The stripe may be continuous or interrupted in an axial direction along the yarn.

In accordance with one embodiment of the present invention there is described a stackable arm chair comprising a frame forming a seat, a back, a pair of front legs, a pair of back legs and a pair of side arms; a side wall extending between the seat and each of the side arms, each of the side walls having an opening adjacent the seat and a corresponding one of the back legs, the size of the opening cooperating with the height of a seat cushion positionable on the seat between the side arms such that the opening is substantially covered by the cushion, the opening being of sufficient size and location to permit passage therethrough of a corresponding back leg of another stackable arm chair of substantially the same construction for arranging the chairs in a nested stack thereof.

In accordance with another embodiment of the present invention there is disclosed a cushioned stackable arm chair comprising a frame forming a seat, a back, a pair of front legs, a pair of back legs and a pair of side arms; a side wall extending between the seat and each of the side arms, the side wall having an opening adjacent the seat and a corresponding one of the back legs; and a seat cushion supported on the seat between the side arms, the height of the cushion and the size of the opening cooperating with each other such that the opening is substantially covered by the cushion, the opening being of sufficient size and location to permit passage therethrough of a corresponding back leg of another stackable arm chair of substantially the same construction for arranging the chairs in a nested stack thereof.

In accordance with another embodiment of the present invention there is described a nested stack of at least two stackable arm chairs, each of the stackable arm chairs comprising a frame forming a seat, a back, a pair of front legs, a pair of back legs and a pair of side arms; a side wall extending between the seat and each of the side arms, each of the side walls having an opening adjacent the seat and a corresponding one of the back legs, the size of the opening cooperating with the length of a seat cushion positionable on the seat between the side arms such that the opening is substantially covered by the cushion, the opening being of sufficient size and location to permit passage therethrough of a corresponding back leg of the other of the at least two stackable arm chairs of substantially the same construction for arranging the chairs in the nested stack thereof.

BRIEF DESCRIPTION OF THE DRAWINGS

The above description, as well as further objects, features and advantages of the present invention will be more fully understood with reference to the following detailed description of a stackable arm chair having a removable seat cushion, the chair constructed from a yarn having wicker appearance, when taken in conjunction with the accompanying drawings, wherein.

DETAILED DESCRIPTION

Figure 1:
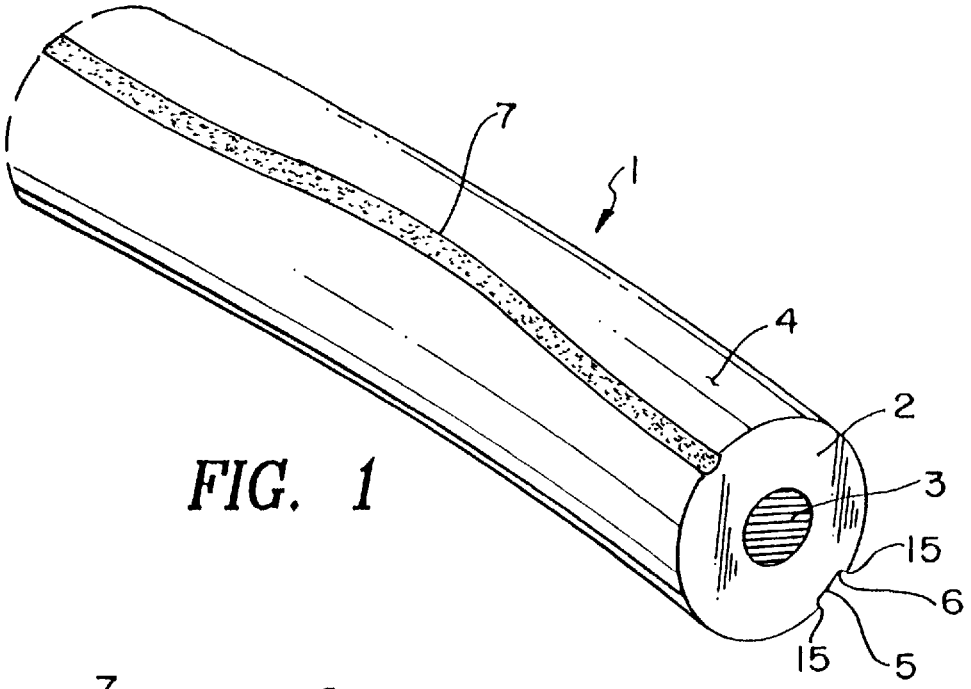
FIG. 1 is a perspective view of a yarn according to one embodiment of the invention having one stripe and one groove.

Referring now to the drawings, there is shown in FIG. 1 a yarn designated generally as reference number 1 constructed in accordance with one embodiment of the present invention. The yarn 1 shown is constructed as an elongated body, such as of indeterminate length, having a core 3 surrounded by a PVC outer coating 2, for example, foamed PVC material which gives greater volume with less material. However, it is to be understood that the outer coating 2 may be formed of other synthetic materials if desired such as polyamides, polyesters and the like. The yarn may be made in a single step using a coextrusion process, as is known in the art. The inner core may include a single filament of polyester, or may include a plurality of polyester filaments bundled to form a single core 3. In addition, the core 3 may be formed of other materials than polyester, monofilament or stranded, such as polyamides and the like. The core 3 is designated to give the yarn 1 greater mechanical strength over yarns formed only of PVC material or the like. However, it is to be understood that the core 3 forms no part of the present invention and may be eliminated if desired. Although the yarn has been shown as cylindrical in shape, other shapes such as square, oval, triangular and the like can be used.

At least one groove 5 is formed on the outer surface 4 of the yarn. The width of the groove at the outer surface may vary from relatively narrow to much wider, for example, about 45°. The groove may have a shallow depth or deeper from the outer surface 4, and may have a cross section comprising a flat floor with radii 6 or may have a generally rounded cross section (not shown). The groove may be formed by a die during the coextrusion process, or may be formed later using a finishing die.

Figure 2:
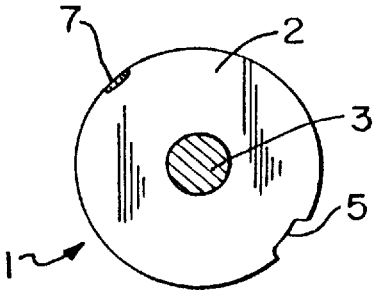
FIG. 2 is a sectional view of the yarn of FIG. 1.

The groove 5 as shown in FIGS. 1 and 2 gives a natural feel to a material woven from the yarn of the invention. The corners 15 formed between the groove 5 and the outer surface 4 of the yarn closely simulates in feel the nicks found in natural wicker materials. Further, the groove itself forms an interruption in the smooth outer surface 4 of the yarn, reflecting light unevenly wherever it is exposed on the surface of material woven from the grooved yarn. The uneven light reflection creates a look closely paralleling the appearance of natural wicker.

Because the groove 5 is a concave feature or inward depression in the outer surface 4 of the yarn, the corners 15 are not so rough as to be uncomfortable to a person seated in a chair made from the yarn, and do not catch clothing. This is a significant advance over designs including convex features such as the star-shaped yarn of the prior art, which may abrade the user and catch clothing.

Figure 6:
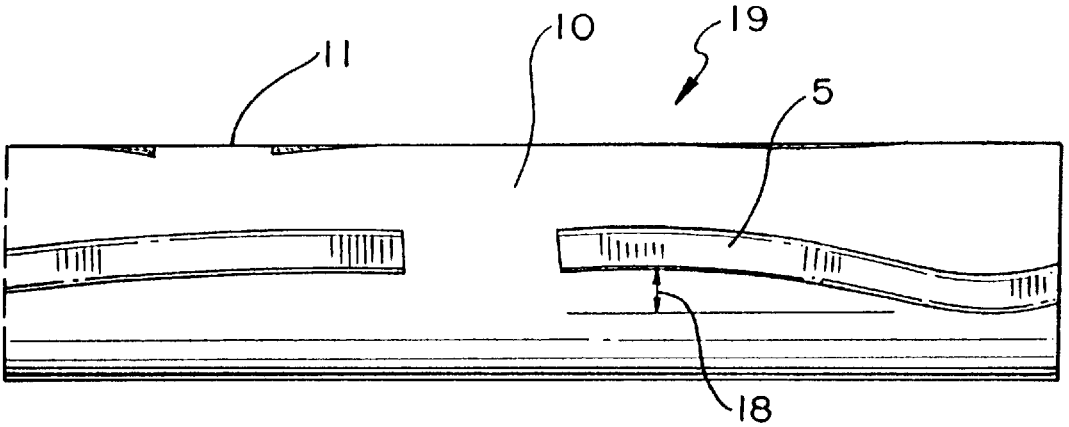
FIG. 6 is an elevation view of the yarn of FIG. 4.
Figure 21:
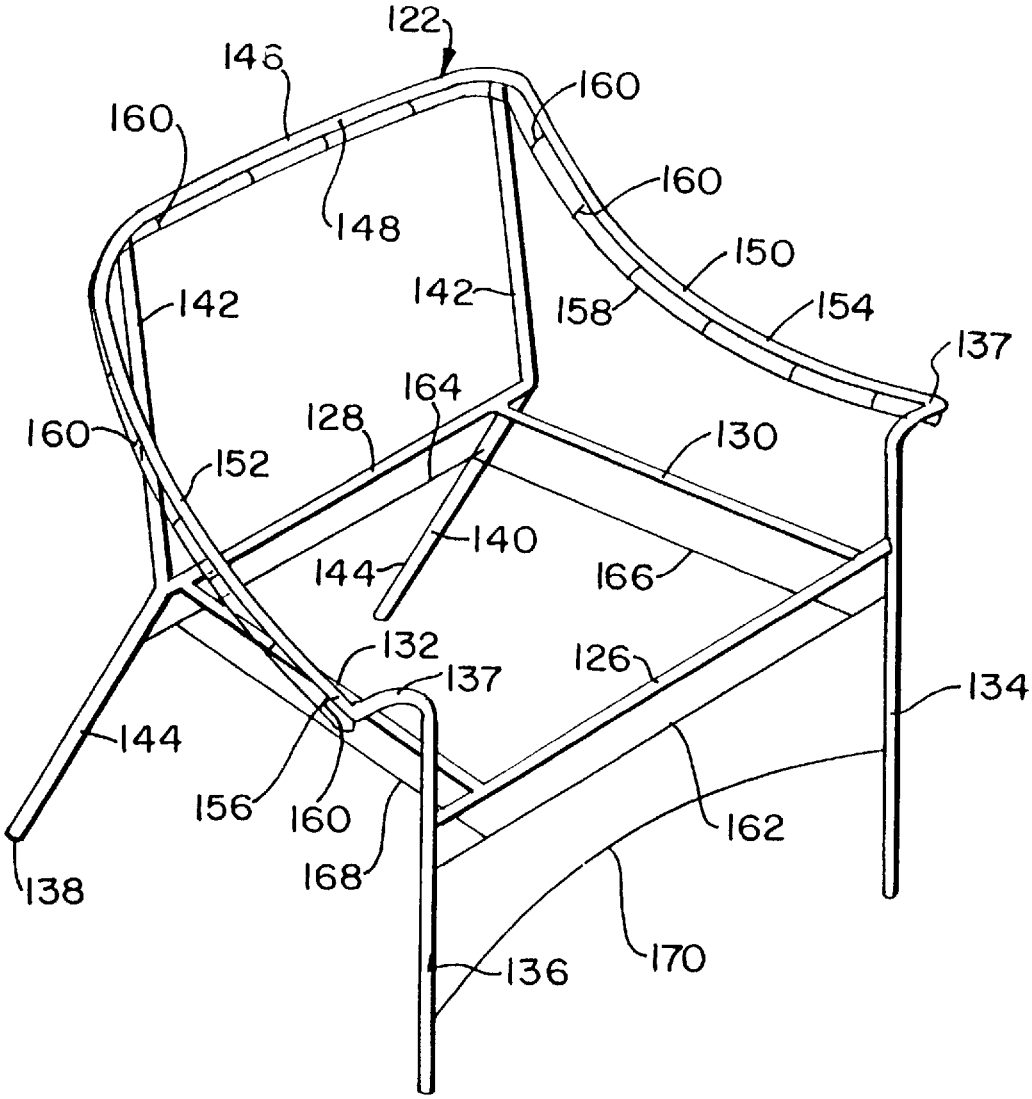
FIG. 21 is a perspective view of a frame forming a stackable arm chair.

The groove 5 may have a wobble 18, as opposed to being straight as shown in FIG. 21, relative to the axis of the yarn, as shown is FIG. 6, in order to more closely duplicate the conditions on a natural wicker fiber. The wobble causes the groove to vary in position around the circumference of the yarn at various points along the axis of the yarn. The wobble of the groove 5 prevents regular patterns from being formed in a material woven from the grooved yarn, instead presenting a random appearance and disappearance of the groove on the surface of the woven material.

Figure 4:
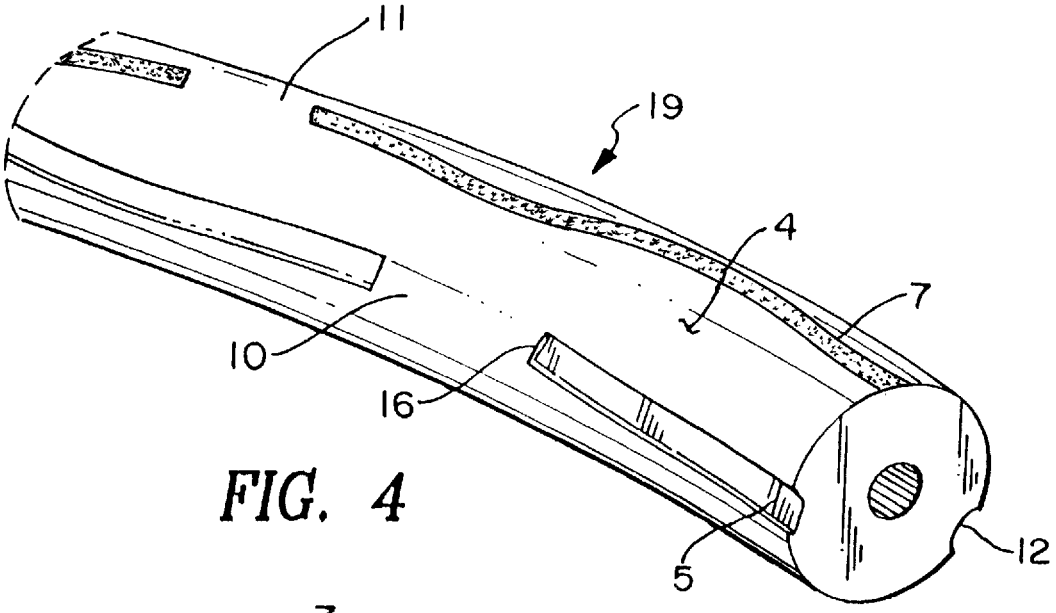
FIG. 4 is a perspective view of a yarn according to another embodiment of the invention having two grooves and one stripe.

In order to further increase the random appearance and disappearance of the groove 5 on the woven material, interruptions 10, shown in FIGS. 4 and 6, may be placed at spaced apart locations along the groove. The interruptions 10 may be of any length and occurrence as desired. In addition to further randomize the light reflected by the woven material, the interruptions 10 form additional corners 16 that present tactile features in an axial direction along the yarn, as compared to the corners 15 that present tactile features in a tangential direction. The corners 16 are detected by a user when running the hand in an axial direction along the yarn, and thus closely simulate the random nicks found on natural wicker materials.

In an alternative form of groove interruption (not shown), a smooth transition is made between the groove 5 and the outer surface 4. This embodiment provides a less prominent tactile feature in the axial direction of the yarn. Accordingly, it can be appreciated that the groove 5 can be constructed in a variety of forms which may be randomly oriented and arranged on the outer surface 4.

Figure 3:
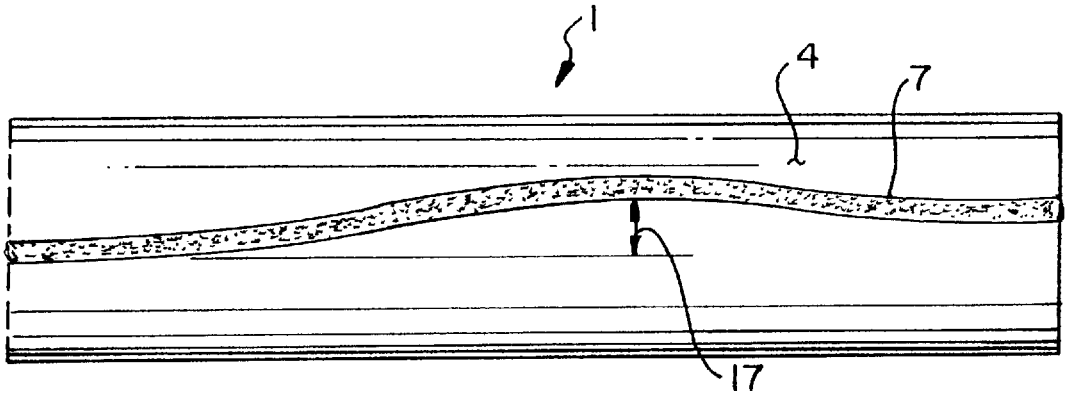
FIG. 3 is an elevation view of the yarn of FIG. 1.

In addition to the grooves 5, at least one stripe 7 is placed on the outer surface 4 of the yarn 1 in order to further enhance the natural look of material woven from the yarn 1, as shown in FIGS. 1–3. The stripe 7 is of a different color or different hue than that of the outer surface 4. In this regard, the stripe 7 provides a visual representation or visual appearance of an area being distinguished from the remaining surface of the yarn 4. For example, on a natural or tan-colored wicker yarn, a black or brown stripe may be used. In another example, a yellow stripe may be used on a green yarn or a gray stripe on a white yarn. As the yarn is woven into a material, the stripe appears at random locations on the surface of the material, interrupting the otherwise uniform color of the surface. These random interruptions simulate the color variations and imperfections of natural wicker fiber, making the woven material closely resemble wicker.

The stripe 7 may have a wobble 17, as opposed to being straight, with respect to the axis of the yarn, as shown in FIG. 3. The wobble further randomizes the appearance of the stripe on the surface of the woven material. In one example of the yarn, the magnitude of wobble of the stripe 7 is approximately equal to that of the grooves.

Figure 5:
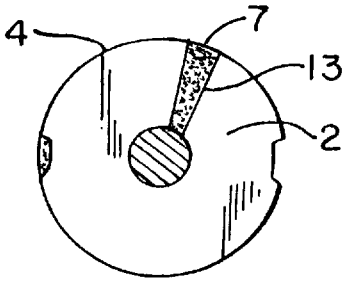
FIG. 5 is a sectional view of the yarn of FIG. 4.

The stripe 7 may be molded into the yarn during the coextrusion process with the core 3 when present, and may extend deep into the yarn as a color portion 13 of the outer coating 2, shown in FIG. 5. Such a configuration is advantageous over painting or inking the stripe 7 on the yarn which may also be used, in that the color portion 13 may not be removed by wear on the outer surface 4. The stripe 7 may incorporate interruptions 11, as shown in FIGS. 4 and 6. The interruptions may be of any length and occurrence as desired. The interruptions 11 simulate the interrupted nicks and scratches appearing on natural wicker fibers.

Additional stripes and/or grooves may be incorporated in the yarn in order to further enhance the natural appearance of a fabric woven from the yarn. In the example shown in FIGS. 4–6, two grooves 5 and 12, located by way of one example approximately 180 degrees apart, are formed on the yarn 19 in conjunction with stripe 7. The use of two grooves increases the frequency that the groove appears on a given surface of the woven material, making the woven material feel and appear rougher.

Figure 7:
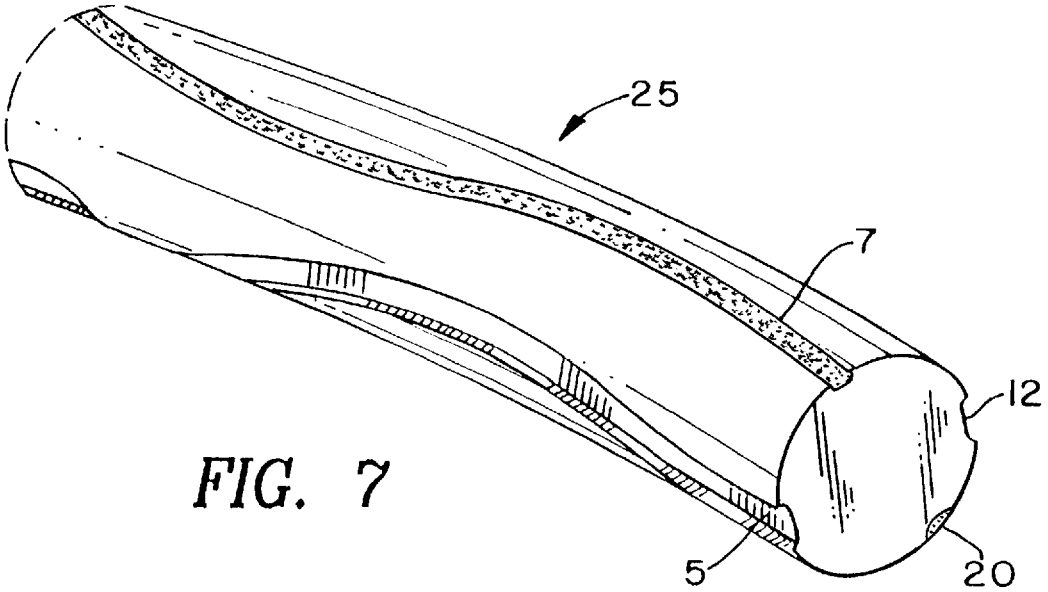
FIG. 7 is a perspective view of a yarn according to another embodiment of the invention having two grooves and two stripes.
Figure 8:
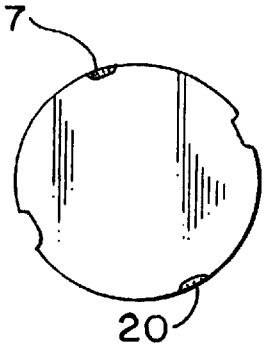
FIG. 8 is a sectional view of the yarn of FIG. 7.
Figure 9:
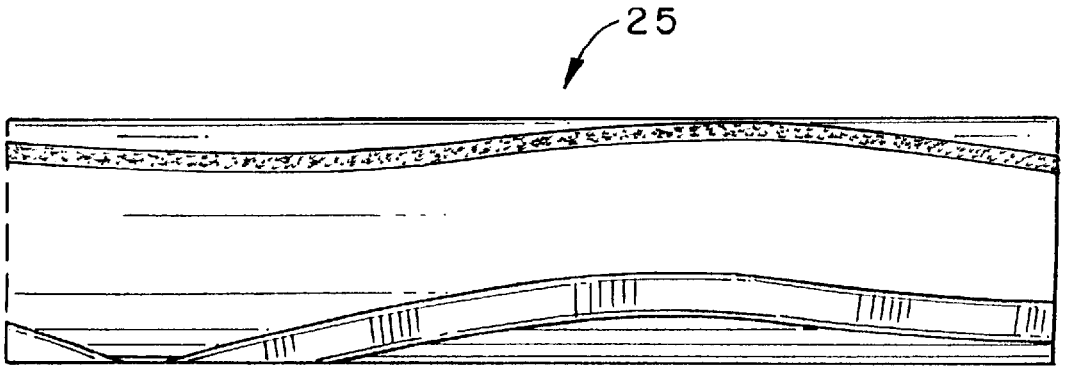
FIG. 9 is an elevation view of the yarn of FIG. 7.
Figure 10:
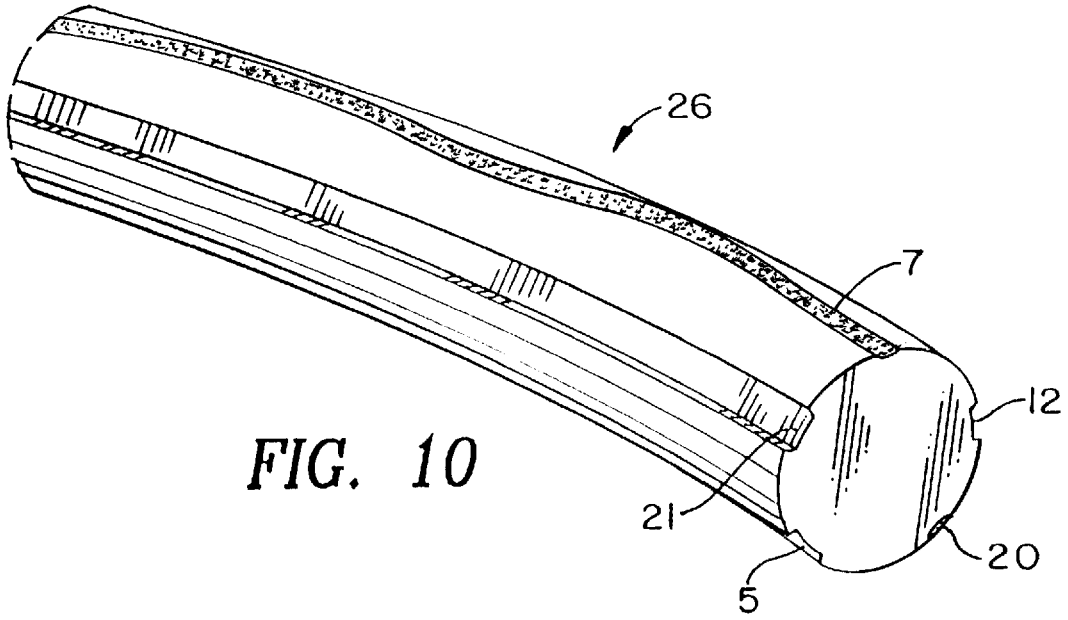
FIG. 10 is a perspective view of the yarn according to another embodiment of the invention having three grooves and two stripes.
Figure 11:
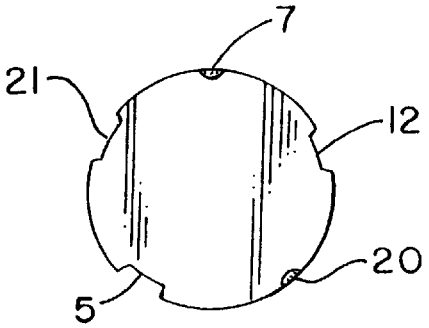
FIG. 11 is a sectional view of the yarn of FIG. 10.
Figure 12:
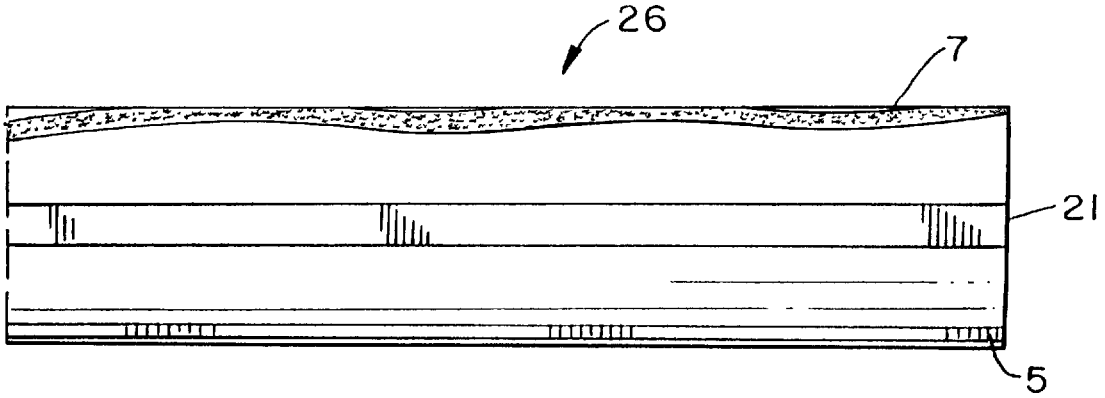
FIG. 12 is an elevation view of the yarn of FIG. 10.

Additional stripes may be placed on the yarn, as shown in FIGS. 7–9. Stripes 7 and 20 are placed on the wicker yarn 25 by way of one example approximately 180 degrees apart. The use of two stripes increases the frequency that a stripe appears on a given surface of the woven material, giving the woven material the appearance of having a larger number of darker or differently colored areas. Additional stripes and/or grooves may be added in order to achieve the desired effect on the finished material. For example, in FIGS. 10–12, three grooves 5, 12, 21, and two stripes 7, 20, are placed around the circumference of the wicker yarn. The stripes 7, 20 wobble with respect to the axis of the wicker yarn as previously described. The grooves 5, 12, 21 as shown do not wobble. The configuration shown in FIGS. 10–12, when woven into a wicker-like material, provides surfaces that are very rough in both look and feel, with a medium amount of random interruption in the color of the material. Other combinations of stripes and grooves on a wicker-like yarn may be utilized in order to achieve varying amounts of roughness and color interruption. The invention is therefore not limited to the examples provided herein, which are only exemplary of the present invention.

Figure 13:
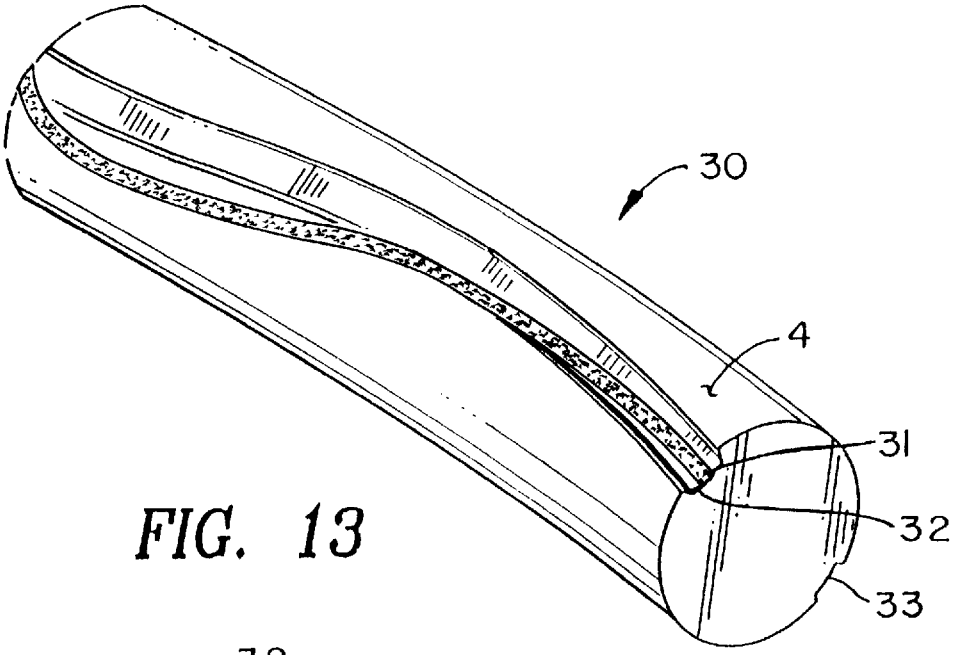
FIG. 13 is a perspective view of a yarn according to another embodiment of the invention having a stripe intersecting a groove.
Figure 14:
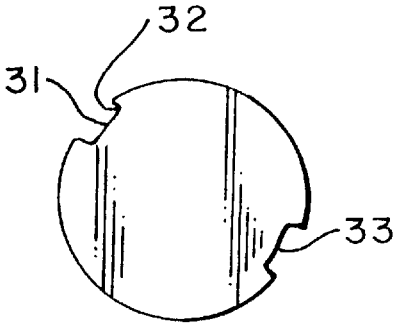
FIG. 14 is a sectional view of the yarn of FIG. 13.
Figure 15:
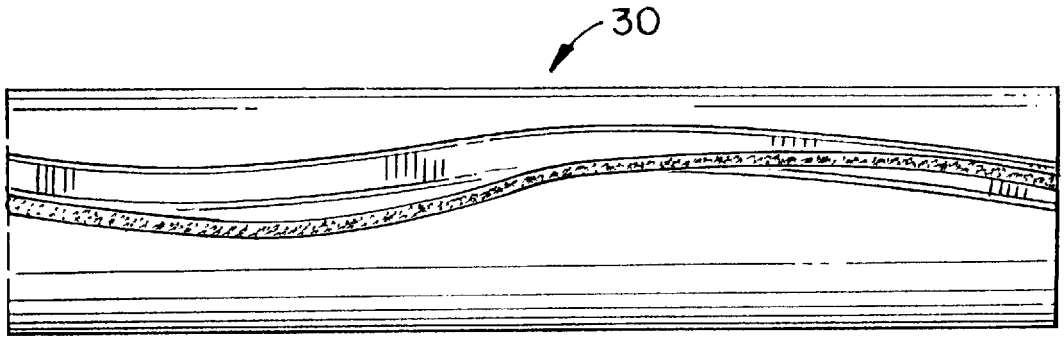
FIG. 15 is an elevation view of the yarn of FIG. 13.

A stripe and a groove provided on a single wicker yarn may remain separated as shown in FIGS. 1–2, or may intersect as shown in FIGS. 13–15. Stripe 31, shown in FIGS. 13–15, is superimposed on the groove 32 at various locations along the axis of the yarn 30. The appearance of a material woven from the yarn 30 is further altered by the changing surface upon which the stripe 31 appears. As the stripe 31 makes a transition from the outer surface 4 of the yarn 30 to the groove 32, the appearance of the stripe changes, giving a different look to the woven material. The use of a stripe intersecting a groove may be combined with the use of multiple grooves, such as grooves 32, 33, shown in FIGS. 13–15, and may also be used in combination with various numbers of grooves and stripes, in order to produce a desired effect on a woven material.

Figure 16:
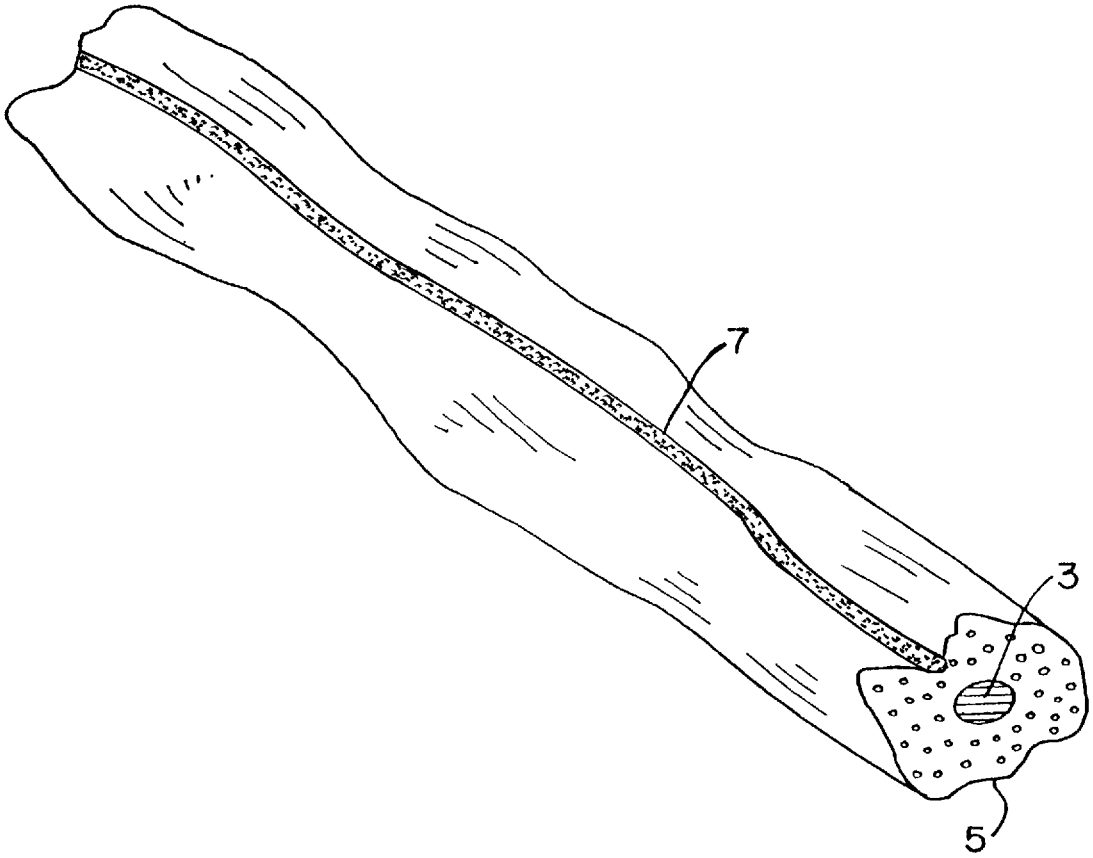
FIG. 16 is a perspective view of the yarn according to the present invention showing the effect of the yarn being formed from foamed PVC material.

As previously described, the yarn 1 is preferably constructed from foamed PVC material which is generally softer than unfoamed PVC material. Foamed PVC material provides about 15% more bulk volume thereby resulting in cost savings. As a result of the lack of uniformity in the foaming of the PVC material during the extrusion process, the resulting yarn lacks a uniform cylindrical appearance. Specifically, as shown in FIG. 16, the outer surface of the yarn is deformed by the absence of a uniform cylindrical surface, such as by having undulations and/or mounds. Not wishing to be bound by any particular theory, it is believed that due to the small volume of PVC material, the PVC material density during the foaming process varies along the length and/or thickness of the yarn so as to cause the deformed shape. This deformed shape results in the yarn having a more natural look to that of real wicker. Yarn constructed from foamed PVC material having at least one random stripe and at least one random groove pursuant to the present invention provides the yarn with a more natural and pleasing appearance which overcomes the objections from the prior yarns used in the construction of casual furniture.

Figure 17:
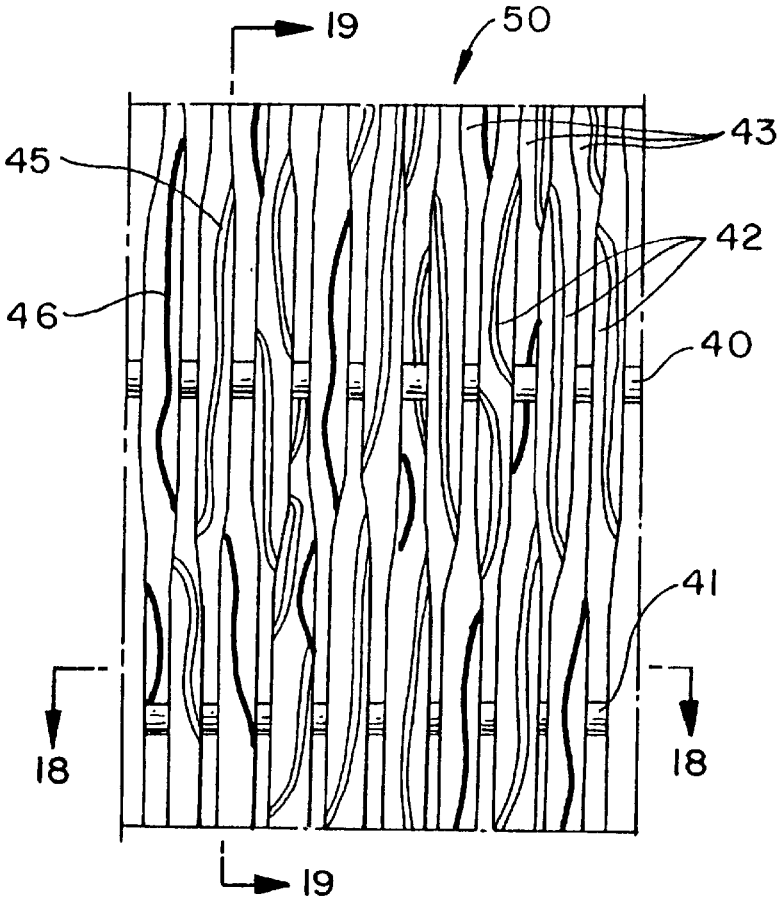
FIG. 17 is a plan view of a material according to the invention woven from polymer yarns having grooves and stripes.
Figure 18:
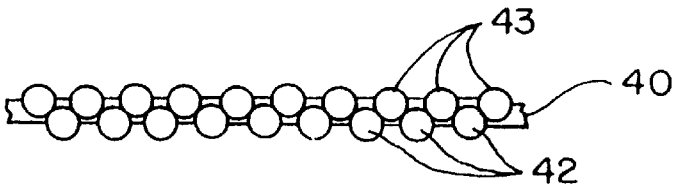
FIG. 18 is a sectional view of the woven yarn taken along line 18—18.
Figure 19:
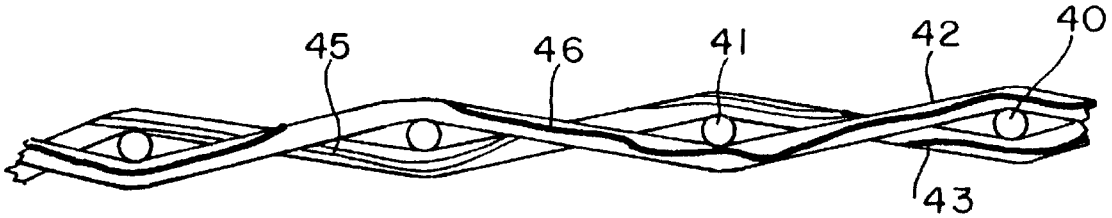
FIG. 19 is a sectional view of the woven yarn taken along line 19—19.

A woven material 50 of the invention comprises warp yarns, such as yarns 40, 41 and weft yarns, such as yarns 42, 43, as shown in the example of FIGS. 17–19. The weave pattern shown in these figures is by way of example, and those skilled in the art will recognize that other weave patterns may be utilized to meet various requirements of strength, look, feel, texture, design, and weight. Warp yarns 40, 41 are placed at even, spaced apart intervals and traverse the material in a substantially straight path. Weft yarns, or "filler" yarns 42, 43 are woven on alternating sides of the warp yarns 40, 41. For example, weft yarns 42 pass on top of the warp yarn 40, while weft yarns 43 pass beneath the warp yarn 40, as shown in FIG. 17. Weft yarns 42 then proceed beneath the warp yarn 41, while weft yarns 43 proceed on top of the warp yarn 41. This weaving pattern is continued throughout a given panel of material. As can be seen in the plan view of FIG. 17, grooves 45 and stripes 46 on the weft yarns 42, 43 impart a random "natural" wicker look to the woven material. In the example shown in FIGS. 17–19, each weft yarn has a single groove and a single stripe, both of which wobble with respect to the yarn axis. Additional grooves and/or stripes may be added in order to increase the effects each of those elements has on the overall look of the material 50.

It is to be understood that it is not required that the warp yarns 40, 41 include stripes and grooves of the present invention. In this regard, the warp yarns 40, 41 can be convention yarns as they are generally concealed by the weft yarns 42, 43. Similarly, it is not required that all of the weft yarns 42,43 be constructed in accordance with the present invention. Other conventional yarns can be combined with the weft yarns 42, 43 to give the weave 50 a particular look which still retains a wicker look and feel without departing from the present invention.

The wicker-like yarns to be woven into material, such as material 50, may if desired be heated before the weaving process, or may be woven immediately after the coextrusion process before the yarns cool. By weaving the yarns in a heated state, adjacent weft yarns 42, 43 adhere to each other and adhere to the warp yarns 40, 41. In this way, a more stable woven material 50 is produced. Alternatively, an adhesive may be used between the yarns in order to produce similar results if desired.

Figure 20:
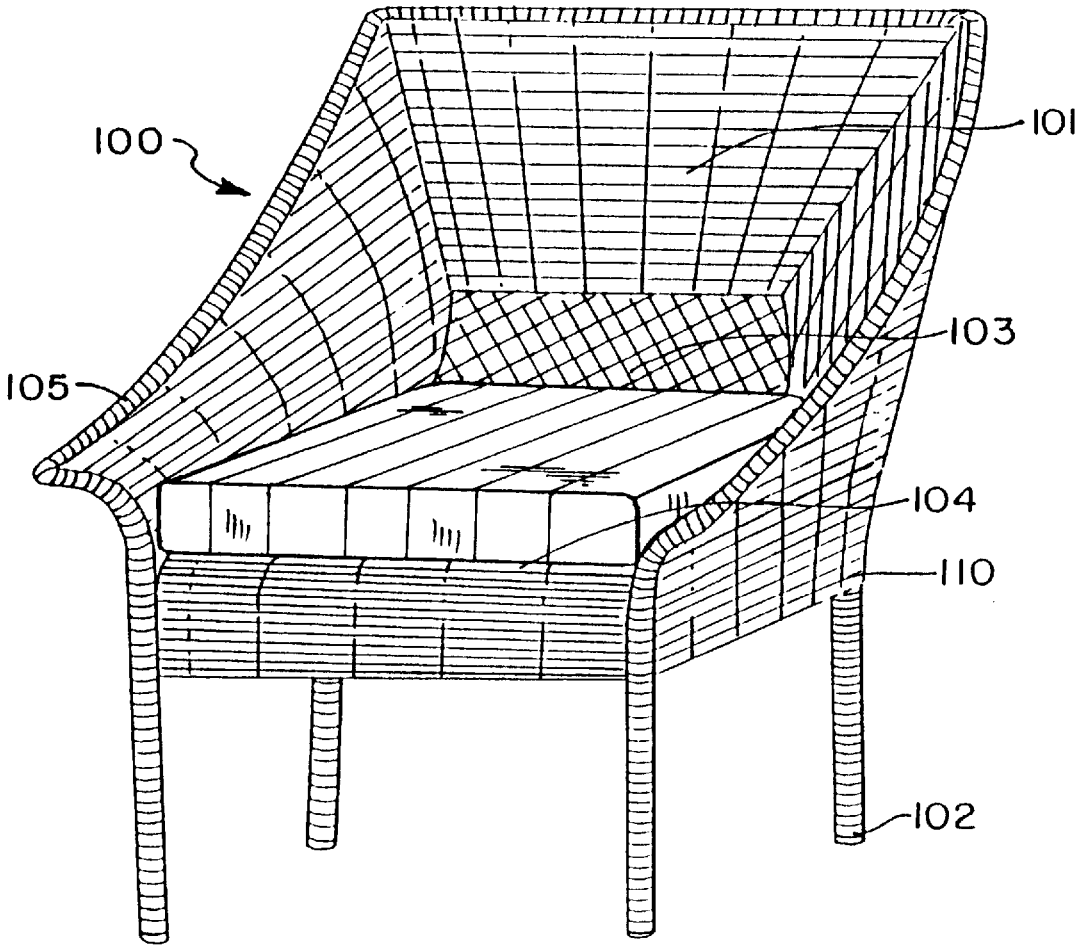
FIG. 20 is perspective view of a cushioned arm chair constructed of yarn according to the invention.

A furniture item of the invention, such as the wicker-like chair 100 shown in FIG. 20, may be produced from a rigid skeletal frame 110 covered by weaving yarns of the invention into woven material panels such as panel 101 forming the back of the chair 100, and panel 104 forming the seat of the chair which are attached to the frame. The chair has a look and feel of natural wicker because of the use of stripes and grooves on the yarn used in making the panels. Yarns with stripes and/or grooves may also be used in wrapping the structural members of the frame such as legs 102 and arms 103, giving those members a natural wicker look as well. Such yarns may also be used in forming lattice work such as the lower chair back 103, which is often formed using the warp yarns of adjacent woven panels. Other furniture items such as couches, tables, benches, stools, trunks, and the like can also be produced using the yarn disclosed in accordance with the present invention so as to have a wicker look.

Chair 100 may be fabricated from wicker yarns of the invention having colors other than the color of natural wicker. Such chairs have the advantages of color coordination offered by a painted wicker chair, while maintaining the random coloration and the slightly rough feel of natural wicker.

Referring now to FIGS. 21–26, there is illustrated pursuant to another aspect of the present invention an arm chair constructed to be stackable and which is suitable for manufacture using any of the yarns as thus far described. The stackable arm chair 120, as shown in FIG. 21, is constructed from a rigid hollow tubular frame 122 which, as to be described hereinafter, provides the stackable arm chair 120 with a seat, a back, a pair of front legs, a pair of back legs and a pair of side arms. The seat 124 is delineated by a connecting front member 126, a parallel spaced apart back member 128 and a pair of parallel spaced apart side members 130, 132. As shown, the front member 126 is somewhat longer than the back member 128, the side members 130,132 being connected to the front and back members slightly inwardly of their terminal ends. As a result, the side members 130, 132 taper inwardly from the front member 126 to the back member 128 such that the forward portion of the seat 124 is wider than the rear portion of the seat.

The front legs 134, 136 are constructed as parallel spaced apart vertical members joined to the free ends of the front member 126 and have outwardly turned extensions 137 providing the front legs with an L-shape. The front legs 134, 136 are arranged generally vertical to the floor as viewed from the front and side of the stackable arm chair 120.

The back legs 138, 140 are constructed from an angular member attached to the free ends of the back member 128. The back legs 138, 140 have generally parallel spaced apart upper members 142 extending vertically from the back member 128 as viewed from the front and side and generally parallel spaced apart lower members 144. The lower members 144 are arranged at a rearwardly extending angle as viewed from the side and extend generally vertical from the back member 128 as shown from the rear of the stackable arm chair 120. As the front member 126 is longer than the back member 128, the distance between the front legs 134, 136 is greater than the distance between the back legs 140, 144. This offset between the front legs 134, 136 and the back legs 138, 140 in conjunction with the rearward tapering of the side members 130, 132 facilitates the stackability of the arm chair 120 as to be described hereinafter.

A generally U-shaped member 146 includes a center section 148 connected across the free ends of the upper members 142 of the back legs 138, 140 and a pair of curved spaced apart side arm members 150, 152 forming the side arms 154, 156 of the arm chair 120. The free ends of the side arm members 150, 152 are attached to the free ends of the extensions 137 of the respective front legs 134, 136. The side arm members 150, 152 are spaced apart wider at their mouth where they connect to the extensions 137 then where they form the center section 148. This arranges the side arms 154, 156 outwardly of the side members 130, 132. The upper members 142 of the back legs 138, 140, the back member 128 and center section 148 of U-shaped 146 delineate the back 157 of the arm chair 120.

A secondary frame provides attachment support for woven material utilized in covering the tubular frame 122. Specifically, a generally U-shaped elongated rod 158 having a shape conforming substantially to the shape of the U-shaped member 146 is connected thereto in underlying relationship by means of a plurality of spaced apart ribs 160. Another secondary support frame is positioned between the front and back legs 134, 136, 138, 140 underlying the seat 124. This secondary frame is constructed from a front rod 162 connected between the front legs 134, 136, a back rod 164 connected between the back legs 138,140 and a pair of side rods 166, 168 arranged in parallel spaced apart relationship connected between the front rod 162 and back rod 164 inwardly of their terminal ends. An additional front rod 170 may be positioned between the front legs 134, 136 underlying front rod 162.

Referring now to FIGS. 22–26, the tubular frame 122 of the stackable arm chair 120 is covered by weaving yarns as previously described and illustrated into woven material panels which are attached to the frame. More specifically, one woven material panel forms the seat 124 by being attached to the back and side members 128, 130, 132 and extending over the front member 126 to where it is ultimately attached to front rod 170. In addition to forming the seat 124, there is also thus formed a front panel 172 or skirt between the front legs 134, 136. A pair of side skirts 174, 176 are formed from secondary woven material panels attached between the side members 130, 132 and corresponding side rods 166, 168. The back 157 of the stackable arm chair 140 is formed from a woven material panel which is wrapped about the U-shaped member 146 and attached along its upper edge to rod 158. The bottom edge of the woven material panel is attached to back rod 164 thereby completing the back 157 of the arm chair 120. The woven material panel also forms a pair of side panels 178, 180 which is provided as an integral extension of the back 157 and forms a front portion of the side skirts 174, 176. An opening 182, 184 is provided in each of the side panels 178, 180. The openings 182, 184 are defined on two sides by the pair of side members 130, 132 and the upper members 142 of the rear legs 138, 140. The other two sides of the openings 182, 184 are bound by a terminal edge of the side panels 178, 180 which may be secured by a suitable rod (not shown) attached, for example, between the rear legs 138, 140 and side rods 166, 168.

Figure 22:
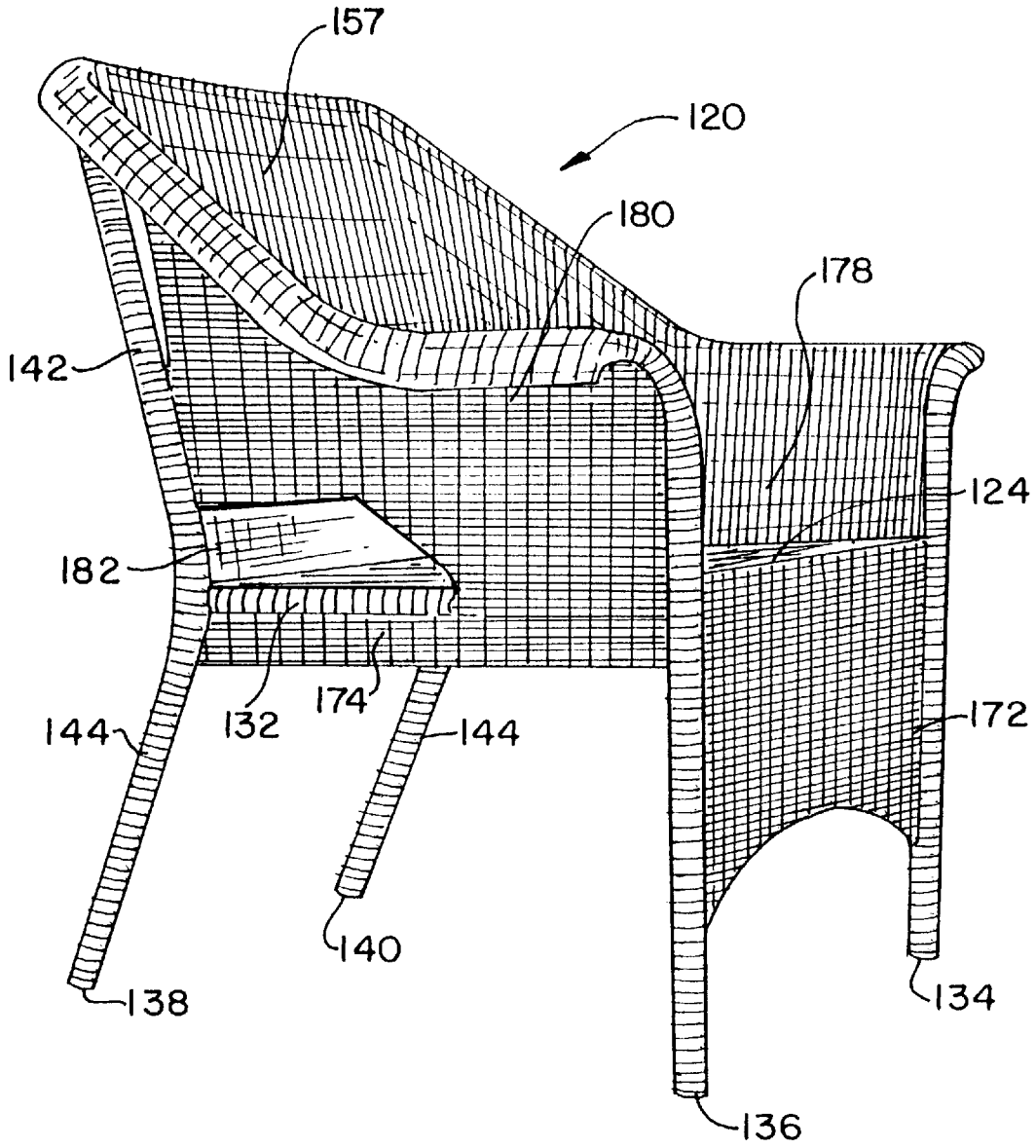
FIG. 22 is a perspective view of a stackable arm chair covered in woven material, constructed in accordance with one embodiment of the present invention.
Figure 23:
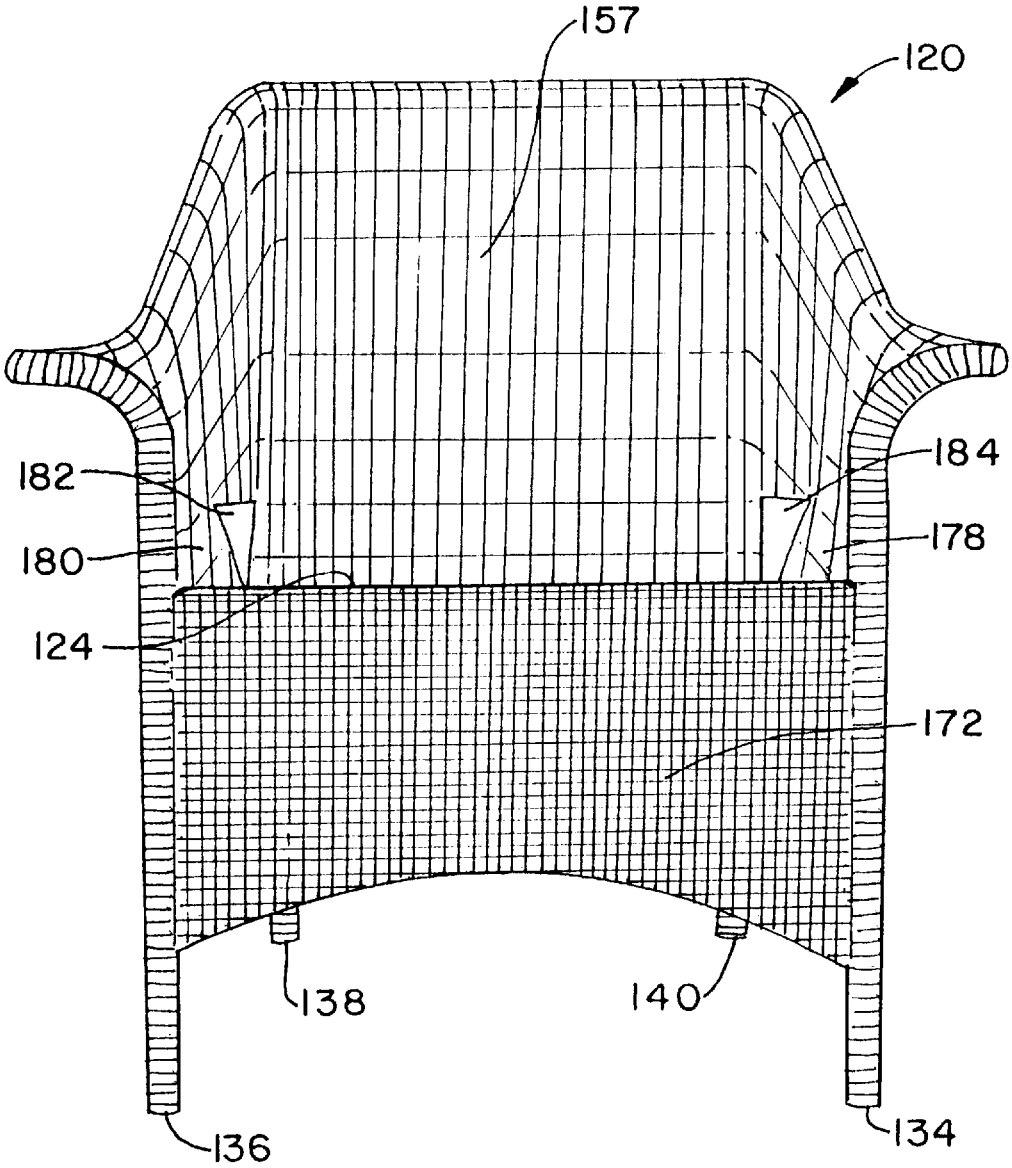
FIG. 23 is front elevational view of the stackable arm chair.
Figure 24:
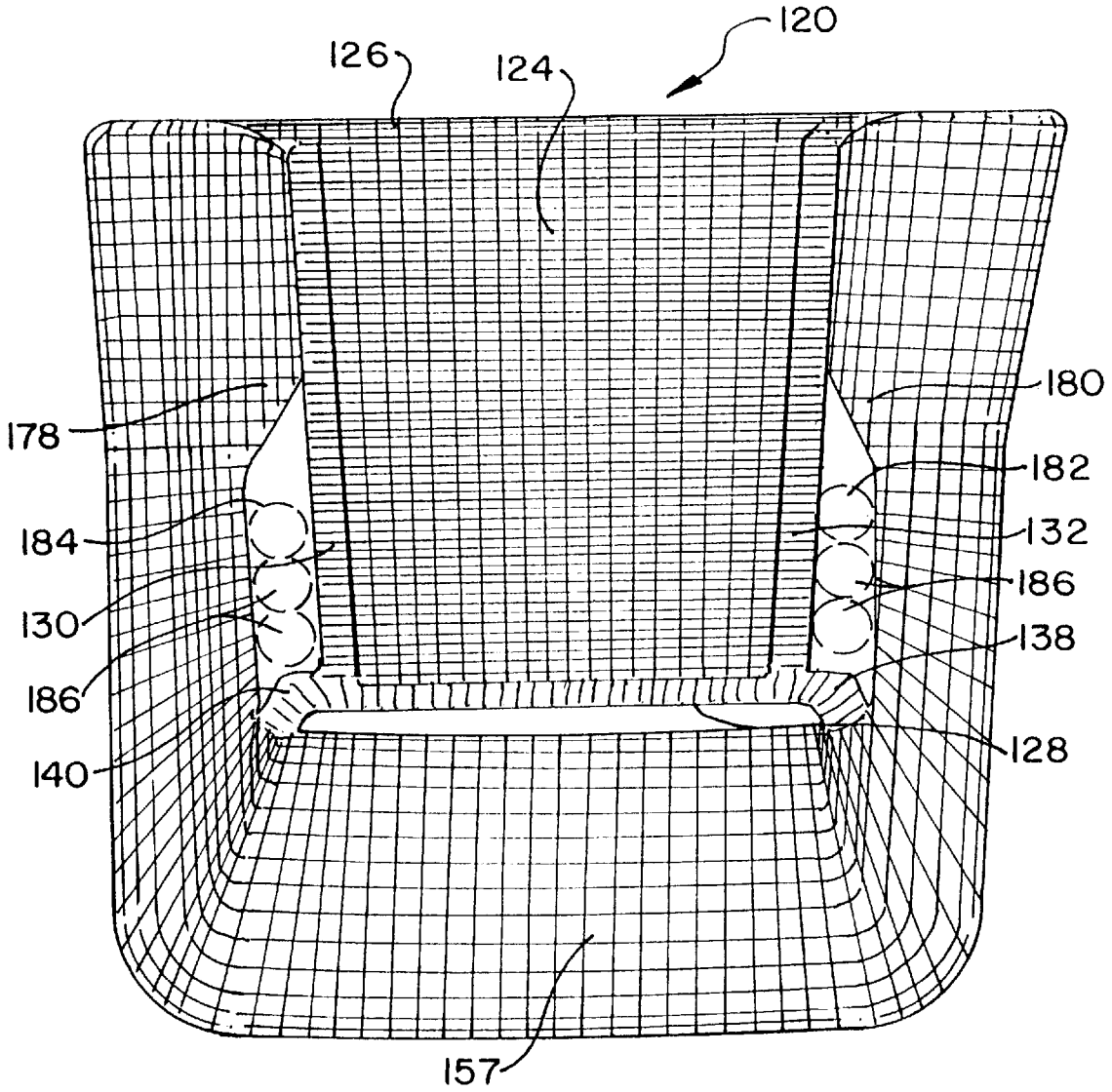
FIG. 24 is a top plan view of the stackable arm chair.
Figure 25:
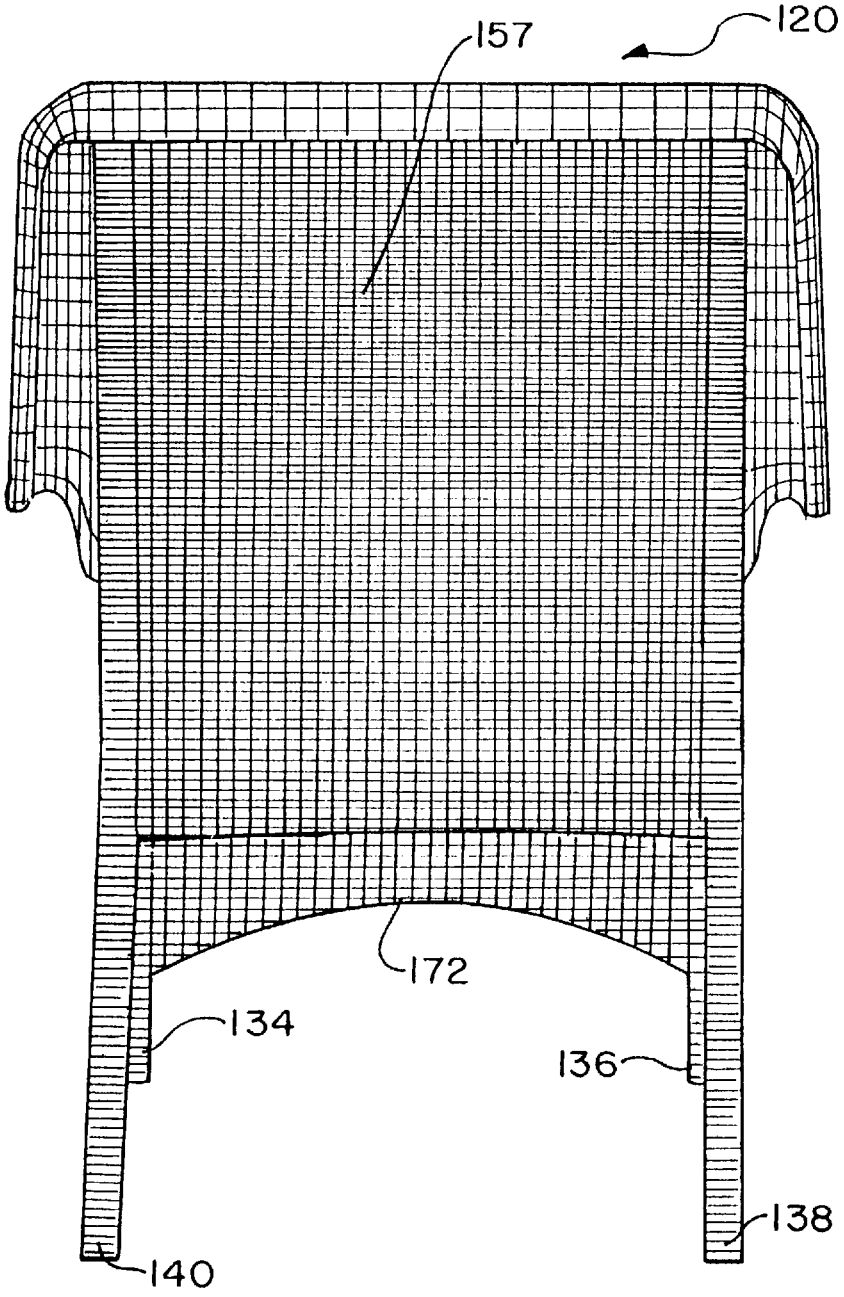
FIG. 25 is a rear elevational view of the stackable arm chair.
Figure 26:
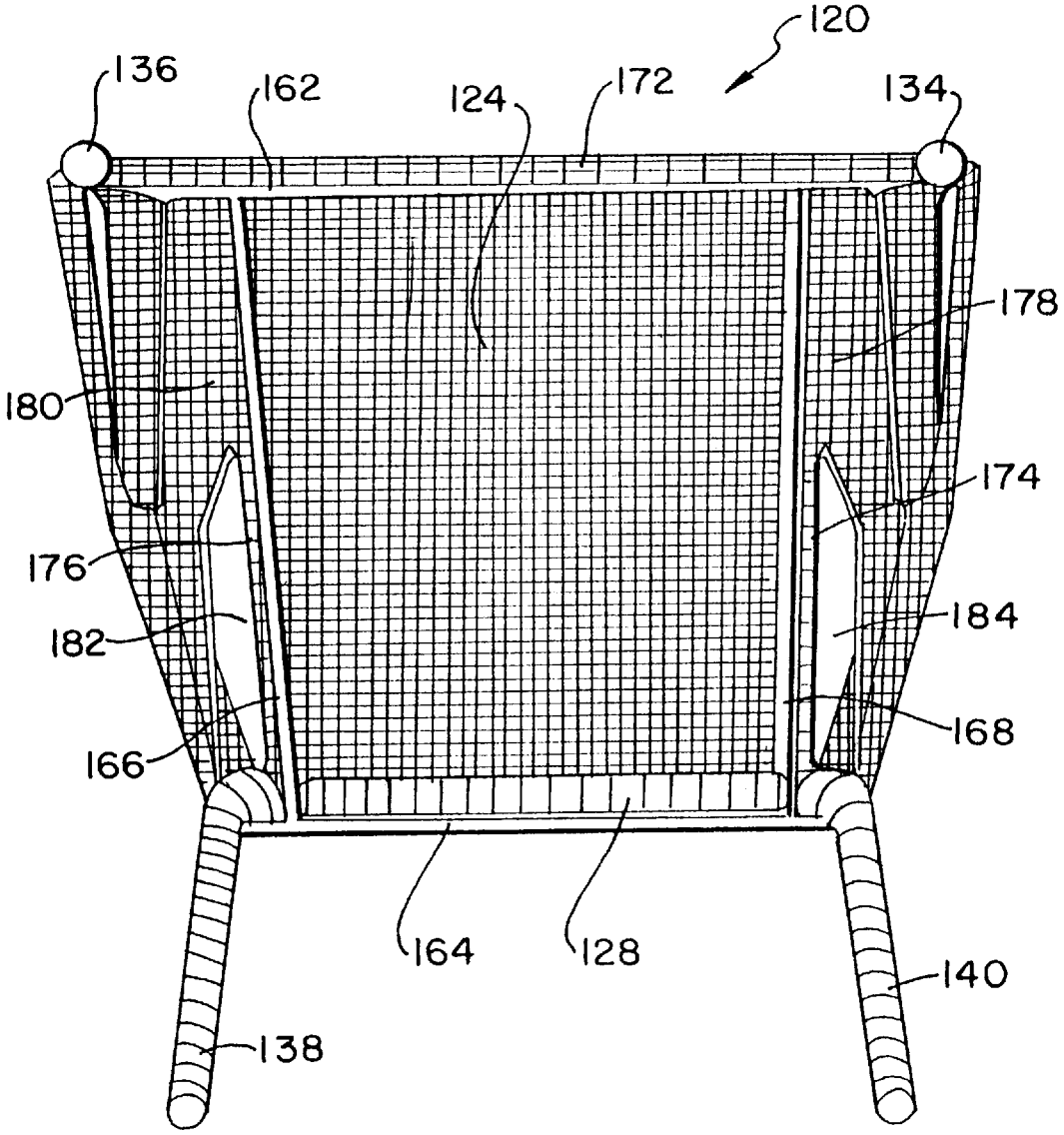
FIG. 26 is a bottom plan view of the stackable arm chair.

As best shown in FIGS. 24 and 26, the side panels 178, 180 taper outwardly from the seat 124 as a result of the side arm members 150, 152 of the U-shaped member 146 being positioned outwardly of the side members 130, 132 which form the sides of the seat. This arrangement allows the openings 182, 184 to extend in both a horizontal and vertical plane. The extent of the openings 182, 184 in the horizontal plane are best shown in FIG. 24, while the extent of the openings in the vertical plane is best shown in FIG. 22. As the openings 182, 184 are defined within both horizontal and vertical planes, there is provided a three dimensional space between the side panels 178, 180 and the side members 130,132 forming the seat 124 as generally indicated by the dotted circular lines 186 in FIG. 24. This three dimensional space, as to be described hereinafter, allows for the stackability of the arm chairs 120.

Figure 27:
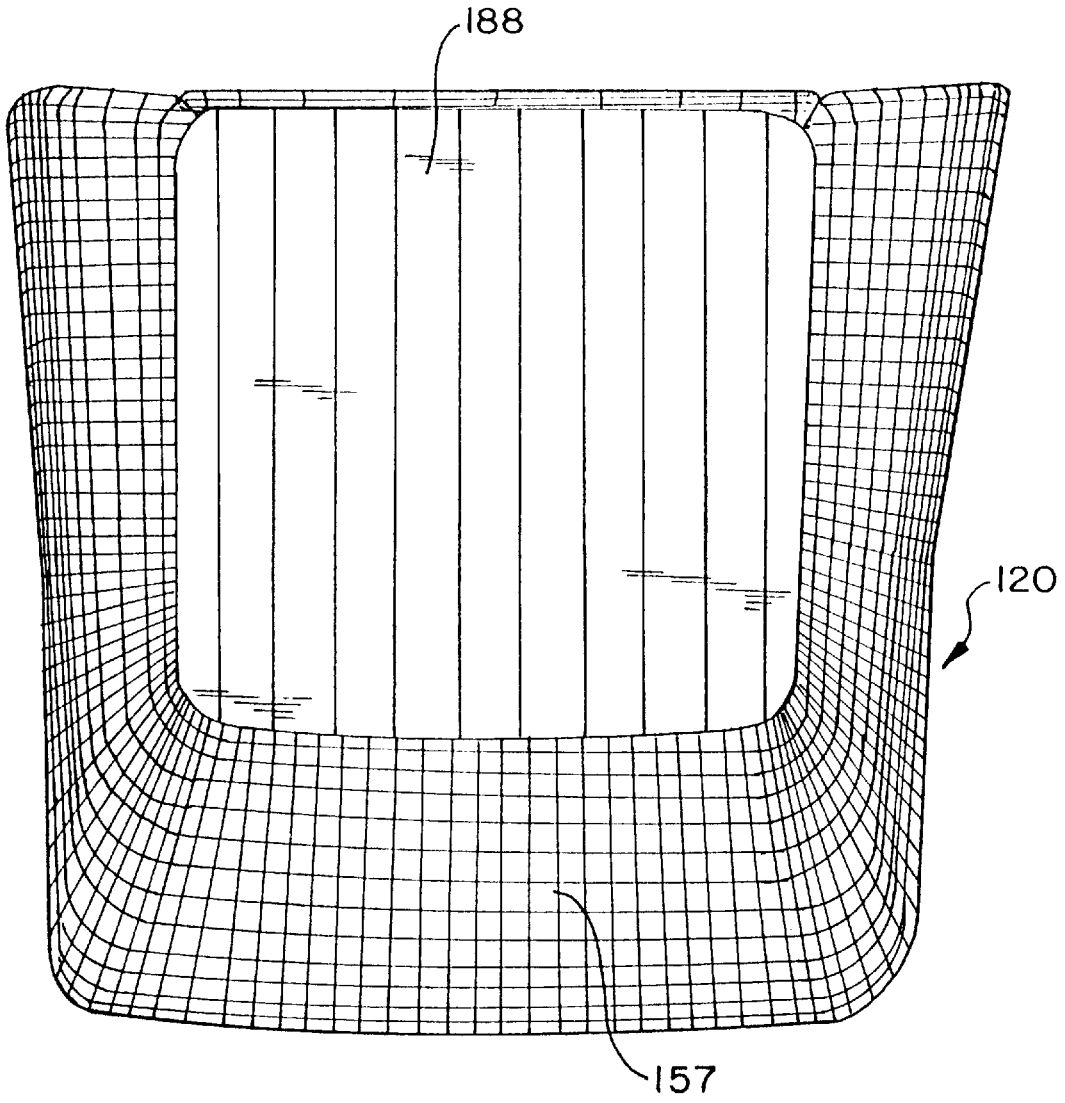
FIG. 27 is a top plan view of the stackable arm chair showing a seat cushion thereon.
Figure 28:
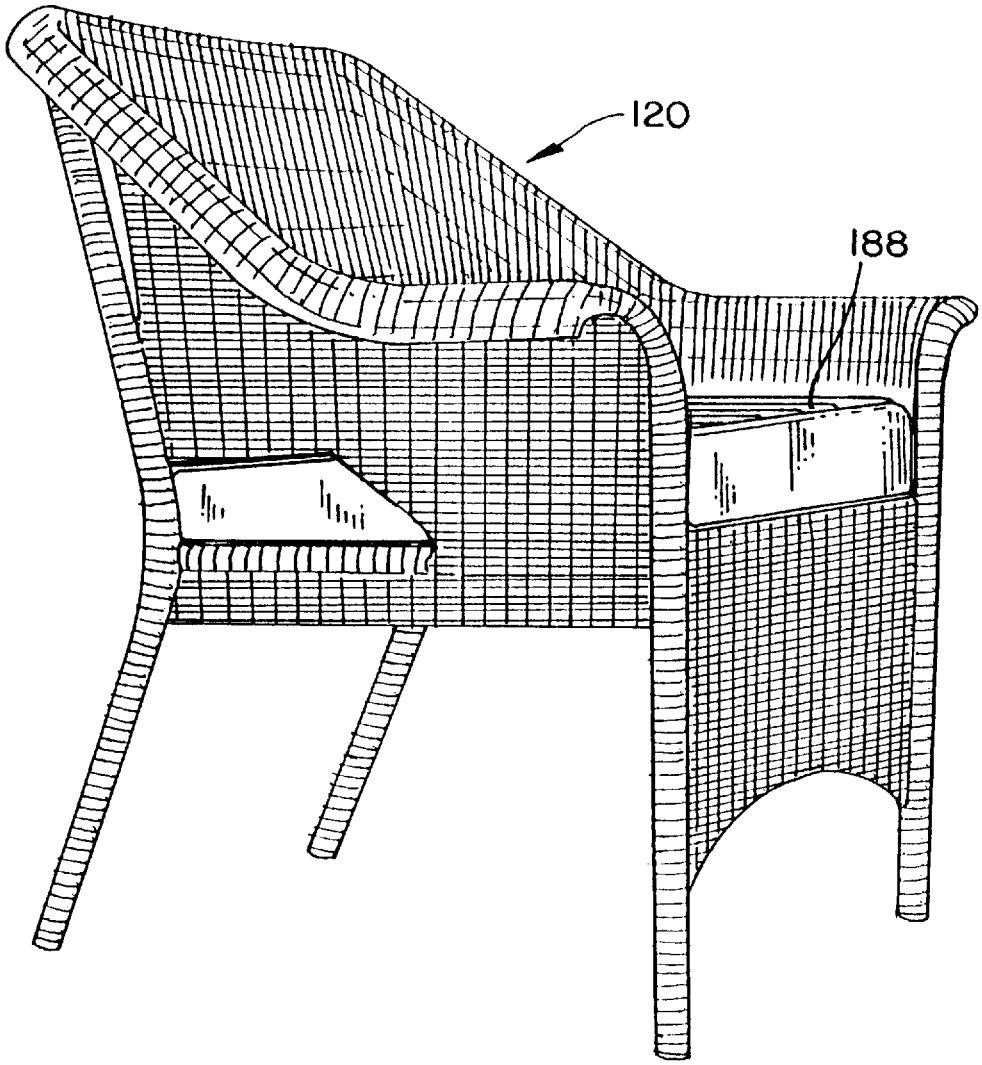
FIG. 28 is a perspective view of the stackable arm chair showing the seat cushion thereon.
Figure 29:
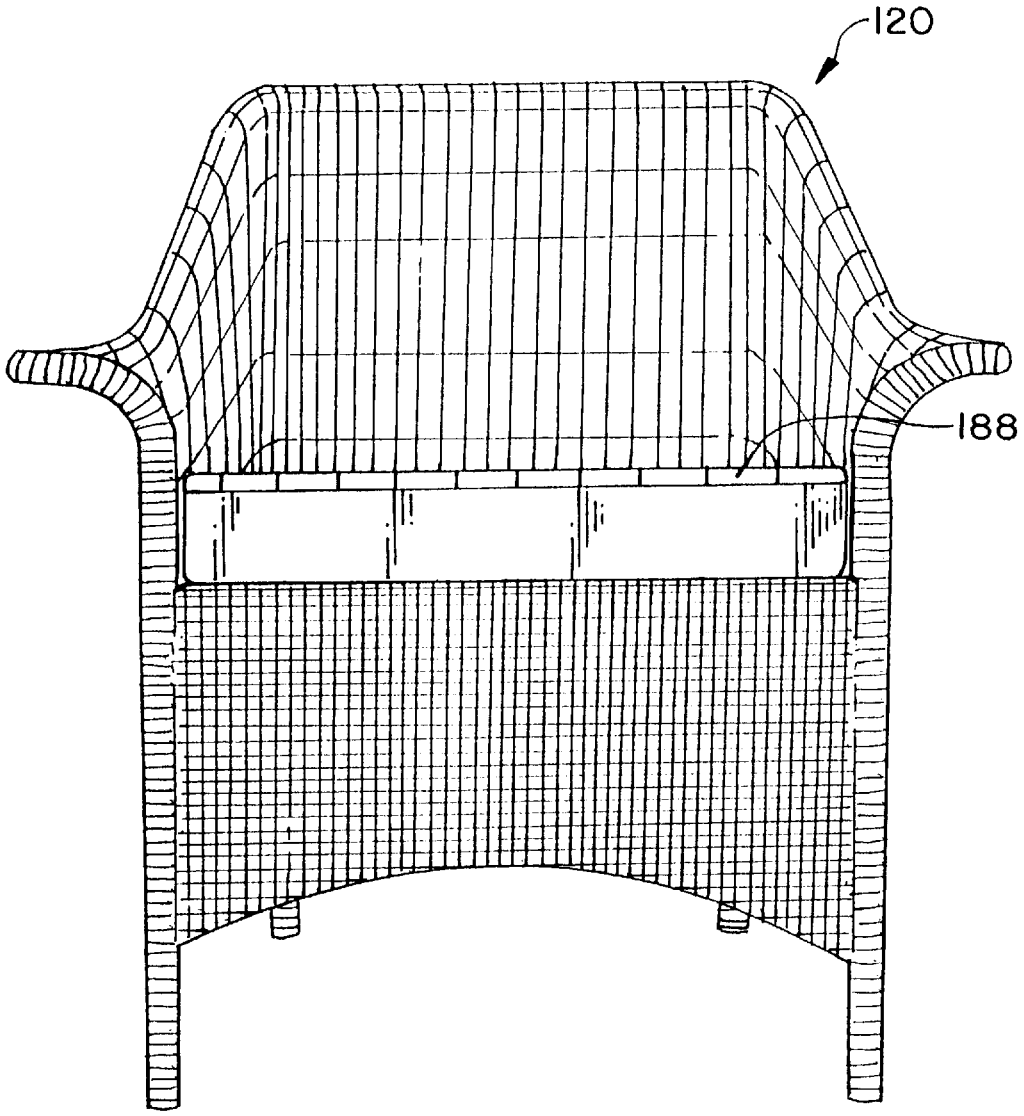
FIG. 29 is a front elevational view of the stackable arm chair showing the seat cushion thereon.

Referring to FIGS. 27–29, the stackable arm chair 120 is adapted to be used in association with a conventional seat cushion 188. The seat cushion 188 is of standard thickness, e.g., about 3½–4½ inches as conventionally used in cushioned outdoor patio furniture. As shown, the size of the openings 182, 184 cooperate with the height and size of the seat cushion 188 such that the openings are substantially blocked from view thereby eliminating the objectionable appearance of the opening. As shown in FIG. 27, the size of the seat cushion 188 is sufficient to substantially cover the openings 182, 184 in the horizontal plane. Similarly as shown in FIGS. 28 and 29, the size of the seat cushion 188 is such to cover the openings 182, 184 in the vertical plane. In other words, the volume of the three dimensional space created by the openings 182, 184 in both horizontal and vertical planes are substantially occupied by a portion of the seat cushion 188. This construction maintains the ornamental and aesthetic characteristics of the stackable arm chair 120 without affecting the ease and simplicity of the stackable feature of the arm chairs.

Figure 30:
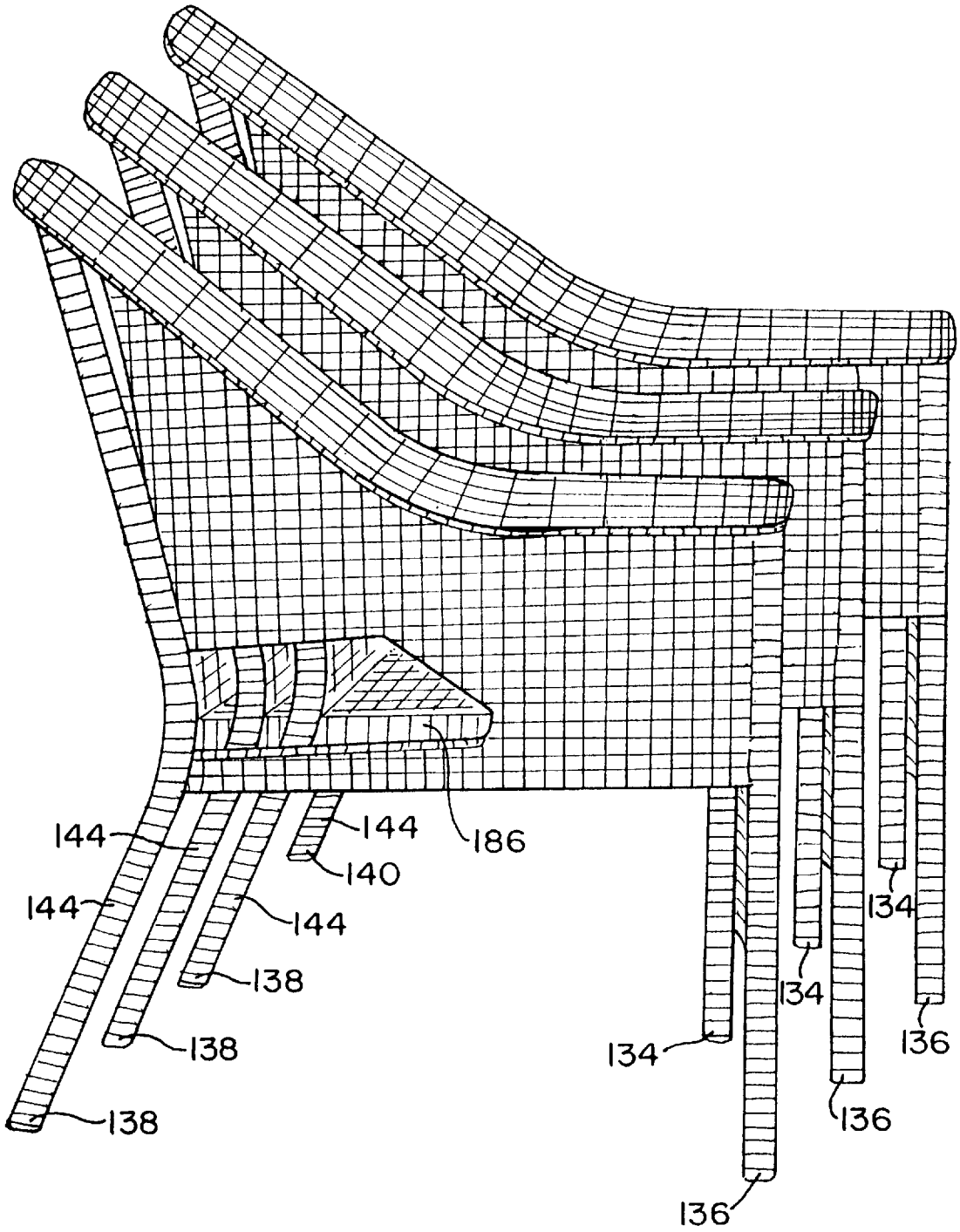
FIG. 30 is a side elevational view showing three stackable arm chairs arranged in a nested forward stack.
Figure 31:
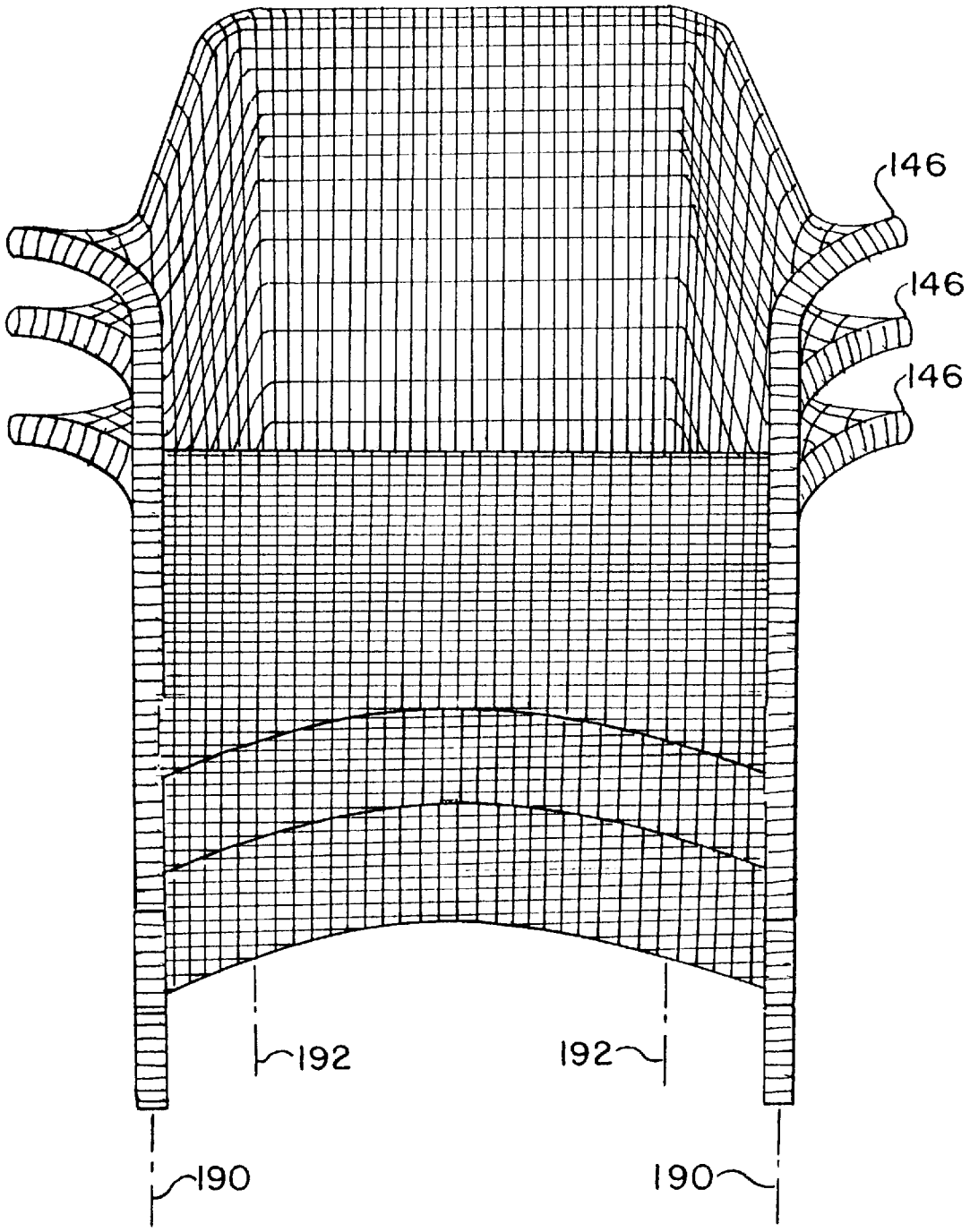
FIG. 31 is a front elevational view showing three stackable arm chairs arranged in a nested forward stack.
Figure 32:
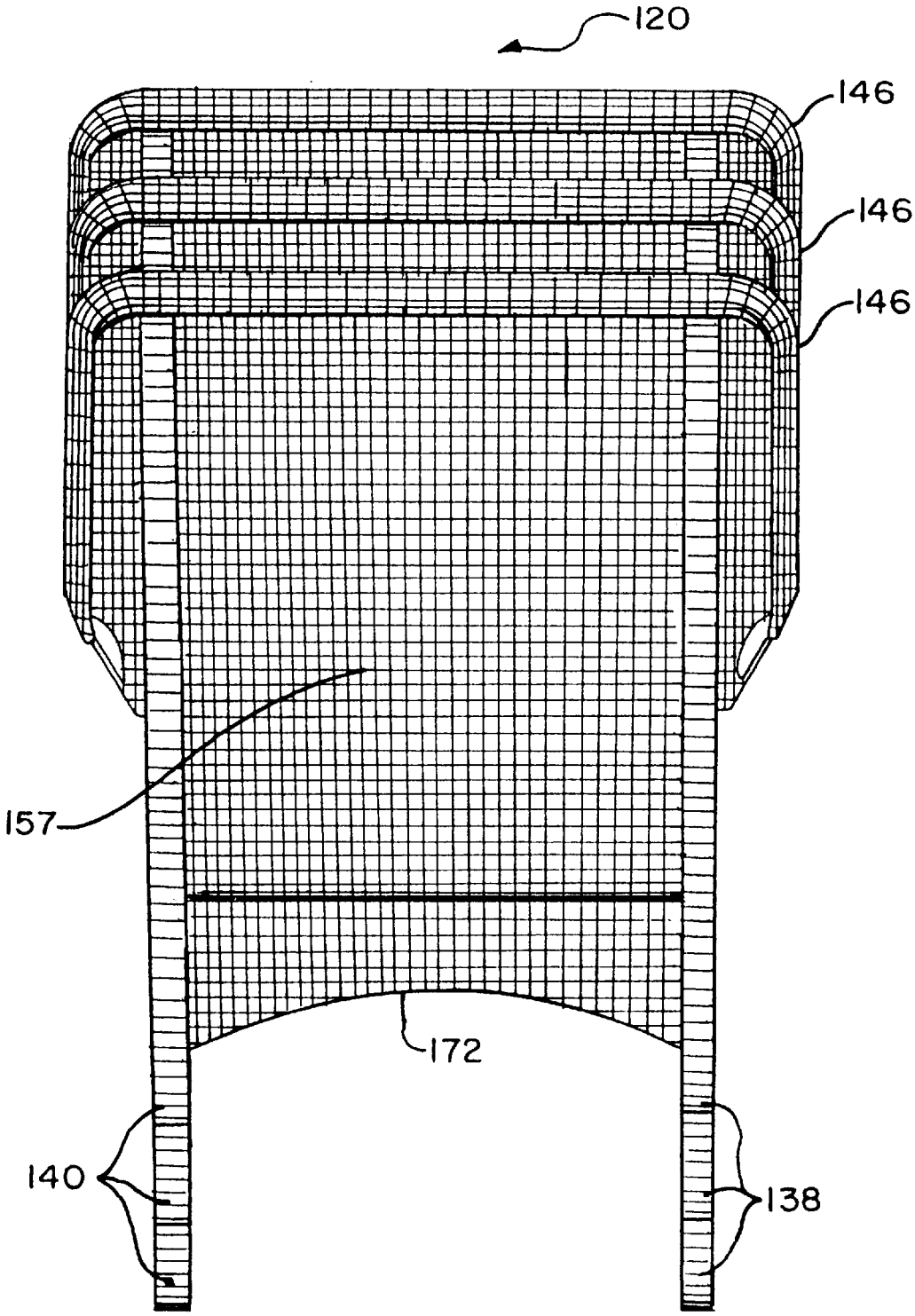
FIG. 32 is a rear elevational view showing three stackable arm chairs arranged in a nested forward stack.

Referring now to FIGS. 30–32, the stacking of the arm chairs 120 in a nested stack will now be described. One objective of stackable chairs in general is to allow the nesting of the chairs in a single stack which occupies a minimum of volume thereby minimizing the size of the storage container and, hence, the space occupied on common carriers during shipping resulting in lower transportation costs. The arm chairs 120 are nested into a single stack by inserting the lower members 144 of the back legs 138, 140 through the three dimensional openings 182, 184 at the location defined by the dotted circular lines 186. In this arrangement, seats 124 and backs 157 of the nested arm chairs 120 will be arranged adjacent one another in overlying relationship. As shown in FIGS. 31 and 32, the front legs 134, 136 and back legs 138, 140 of the nested arm chairs 120 are arranged substantially in alignment with each other within a respective common plane 190, 192, one behind the other. Similarly, the U-shaped members 146 of adjacent nested arm chairs 120 are arranged in substantial alignment with each other, one above the other. As a result of the foregoing construction, the arm chairs 120 are nested as tightly as possible with one another so as to minimize the overall space required by a set of, for example, four nested chairs, which are typically sold as a set. The close nesting of the arm chairs 120 is further facilitated by the absence of any cross bracing between the front and back legs 134, 136, 138, 140 as is conventional with known chair construction.

As the arm chairs 120 are nested with one another, they form what is commonly referred to as a forward stack. As shown in FIG. 30, the nested arm chairs 120 progressively move forward in the stack, as well as upwardly in height. However, because of the close nesting of the arm chairs, the forward and upward displacement of the arm chairs 120 is minimal, thereby minimizing the overall volume occupied by the nested arm chairs.

Although the stackable arm chairs 120 have been described with respect to a particular ornamental appearance and woven material panels, it is to be understood that other designs and shapes, including using other woven material panels from other materials than those described herein encompassing other weaves and yarns may be included in the stackable arm chairs pursuant to the present invention. That is, the present invention is not intended to be limited by any particular woven material panels, yarns or the overall shape of the stackable arm chair 120 illustrated. For example, although the yarn has been shown as generally cylindrical in shape, other shapes such as square, oval, triangular and the like can be used.

Figure 33:
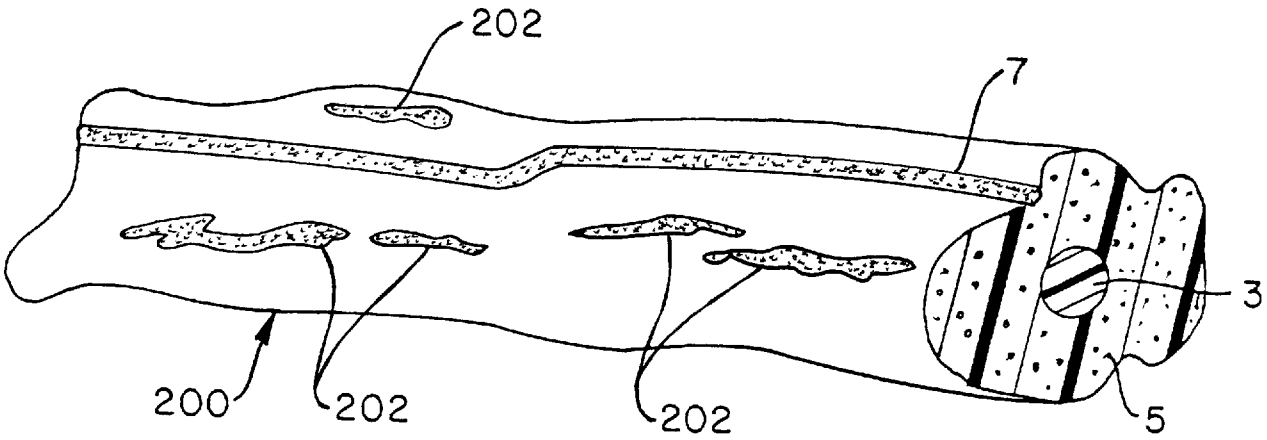
FIG. 33 is a perspective view of a yarn formed in accordance with another embodiment of the present invention.

Referring now to FIG. 33, there is shown a perspective view of a yarn 200 in accordance with another embodiment of the present invention. The yarn 200 can be constructed generally pursuant to any one of the previously described embodiments. In this regard, the yarn 200 can be constructed from a variety of synthetic materials such as polyamides, polyesters and the like. Preferably, the yarn 200 is constructed from foamed PVC material about a center core 3 such as a single filament of polyester or a plurality of polyester filaments bundled to form the core. The yarn 200 may also be provided with one or more grooves 5 and/or stripes 7 in the manner as previously described.

In forming the woven material 50 as shown in FIG. 17, the weft yarns 42, 43 are provided as having a different color from the warp yarns 40, 41. By way of example only, the outer surface of the weft yarns 42, 43 may be green, while the outer surface of the warp yarns 40, 41 may be bone.

During the weaving process, the warp yarns 40, 41 are pulled through the weft yarns 42, 43 within the woven material 50. As the warp yarns 40, 41 are pulled through the woven material 50, there is created friction with the weft yarns 42, 43. This friction results in the random and non-uniform transfer of small portions of the material forming the weft yarns 42, 43 onto the outer surface of the warp yarns 40, 41 as generally designated at locations 202. This random and non-uniform transfer of the different colored material from the weft yarns 42, 43 to the warp yarns 40, 41 creates a more natural and unique attractive appearance to the warp yarns and the overall woven material 50. As a result, there is provided an overall enhanced pleasing appearance to the woven material 50. This effect is greater depending upon the extent of the contrast color between the weft and warp yarns. It is contemplated that a greater amount of transfer of material from the weft yarns 42, 43 to the warp yarns 40, 41 will be achieved by constructing the yarns from foamed material, such as PVC material, which is generally softer than non-foamed materials. Accordingly, by constructing the woven material 50 from foamed PVC material having an irregular surface, including one or more stripes 7 and/or one or more grooves 5 along with contrasting colors, the woven material can be provided with a unique look heretofore unknown.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

I claim:

1. A stackable arm chair comprising a frame forming a seat, a back, a pair of front legs, a pair of back legs and a pair of side arms; a seat cushion; a side wall extending between said seat and each of said side arms, said side wall arranged at an angle extending upwardly and outwardly from said seat, each of said side walls having an opening adjacent said seat and a corresponding one of said back legs, said opening extending in a horizontal and vertical plane to allow passage of said back legs therethrough, the size of said opening being substantially the same or less than the height of said seat cushion positionable on said seat between said side arms such that said opening is substantially covered by said cushion, said opening being of sufficient size and location to permit passage therethrough of a corresponding back leg of another stackable arm chair of substantially the same construction for arranging said chairs in a nested stack thereof.

2. The stackable arm chair of claim 1, further including at least one panel woven from a yarn comprising an elongated body of polymer material having an outer surface, at least one groove on said outer surface extending substantially in an axial direction along said body, and at least one visual representation of a stripe on said outer surface extending in substantially an axial direction along said body, said groove and said stripe being visible on said panel.

3. The stackable arm chair as claimed in claim 2, wherein said stripe and said groove vary in position around a circumference of said yarn.

4. The stackable arm chair as claimed in claim 2, wherein said frame comprises a structural member wrapped with said yarn.

5. The stackable arm chair of claim 2, wherein said yarn comprises foamed PVC material.

6. The stackable arm chair of claim 2, wherein said panel forms at least one of said seat and said back of said chair.

7. The stackable arm chair of claim 2, wherein said panel comprises a plurality of spaced warp yarns and a plurality of weft yarns woven with said warp yarns, said weft yarns comprising said elongated body of polymer material having an outer surface of a first color, said groove on said outer surface extending substantially in an axial direction along said body, and said stripe being of a second color on said outer surface extending substantially in an axial direction along said body, wherein said at least one stripe and at least one groove are exposed on at least a portion of a surface of the woven material at spaced locations.

8. The stackable arm chair of claim 1, wherein said seat has a front edge between said front legs and a back edge between said back legs, said front edge being longer than said back edge, whereby the back legs of said another stackable chair of substantially the same constructions are arranged in substantial parallel alignment with said back legs of said chair when arranged in said nested stack.

9. The stackable arm chair of claim 8, wherein the front legs of said another stackable chair of substantially the same construction are arranged in substantial parallel alignment with the front legs of said chair when arranged in said nested stack.

10. The stackable arm chair of claim 1, wherein said opening extends between the edges of said seat to said corresponding one of said back legs and placed from a corresponding one of said side arms.

11. A cushioned stackable arm chair comprising a frame forming a seat, a back, a pair of front legs, a pair of back legs and a pair of side arms; a side wall extending between said seat and each of said side arms, said side wall arranged at an angle extending upwardly and outwardly from said seat, said side wall having an opening adjacent said seat and a corresponding one of said back legs, said opening extending in a horizontal and vertical plane to allow passage of said back legs therethrough; and a seat cushion supported on said seat between said side arms, the height of said cushion being substantially the same or greater than the size of said opening such that said opening is substantially covered by said cushion, said opening being of sufficient size and location to permit passage therethrough of a corresponding back leg of another stackable arm chair of substantially the same construction for arranging said chairs in a nested stack thereof.

12. The stackable arm chair of claim 11, further including at least one panel woven from a yarn comprising an elongated body of polymer material having an outer surface of a first color, said yarn having at least one stripe of a second color and at least one groove, said stripe and said groove running substantially in an axial direction on said outer surface of said yarn, said groove and said stripe being visible on said panel.

13. The stackable arm chair as claimed in claim 12, wherein said stripe and said groove vary in position around a circumference of said yarn.

14. The stackable arm chair as claimed in claim 12, wherein said frame comprises a structural member wrapped with said yarn.

15. The stackable arm chair of claim 12, wherein said yarn comprises foamed PVC material.

16. The stackable arm chair of claim 12, wherein said panel forms at least one of said seat and said back of said chair.

17. The stackable arm chair of claim 11, wherein said seat has a front edge between said front legs and a back edge between said back legs, said front edge being longer than said back edge, whereby the back legs of said another stackable chair of substantially the same constructions are arranged in substantial parallel alignment with said back legs of said chair when arranged in said nested stack.

18. The stackable arm chair of claim 17, wherein the front legs of said another stackable chair of substantially the same construction are arranged in substantial parallel alignment with the front legs of said chair when arranged in said nested stack.

19. The stackable arm chair of claim 11, wherein said opening extends between the edges of said seat to said corresponding one of said back legs and spaced from a corresponding one of said side arms.

20. A nested stack of at least two stackable arm chairs, each of said stackable arm chairs comprising a frame forming a seat, a back, a pair of front legs, a pair of back legs and a pair of side arms; a seat cushion; a side wall extending between said seat and each of said side arms, said side wall arranged at an angle extending upwardly and outwardly from said seat, each of said side walls having an opening adjacent said seat and a corresponding one of said back legs, said opening extending in a horizontal and vertical plane to allow passage of said back legs therethrough, the size of said opening being substantially the same or less than the height of said seat cushion positionable on said seat between said side arms such that said opening is substantially covered by said cushion, said opening being of sufficient size and location to permit passage therethrough of a corresponding back leg of the other of said at least two stackable arm chairs of substantially the same construction for arranging said chairs in said nested stack thereof.

21. The stackable arm chair of claim 20, further including at least one panel woven from a yarn comprising an elongated body of polymer material having an outer surface, at least one groove on said outer surface extending substantially in an axial direction along said body, and at least one visual representation of a stripe on said outer surface extending in substantially an axial direction along said body, said groove and said stripe being visible on said panel.

22. The stackable arm chair of claim 21, wherein said yarn comprises foamed PVC material.

23. The stackable arm chair of claim 21, wherein said panel forms at least one of said seat and said back of said chair.

24. The stackable arm chair of claim 20, wherein said seat has a front edge between said front legs and a back edge between said back legs, said front edge being longer than said back edge, whereby the back legs of said another stackable chair of substantially the same constructions are arranged in substantial parallel alignment with said back legs of said chair when arranged in said nested stack.

25. The stackable arm chair of claim 24, wherein the front legs of said another stackable chair of substantially the same construction are arranged in substantial parallel alignment with the front legs of said chair when arranged in said nested stack.

26. The stackable arm chair of claim 20, wherein said opening extends between the edges of said seat to said corresponding one of said back legs and spaced from a corresponding one of said side arms.

27. The nested stack of claim 20, further including a rectangular frame attached between said front legs and said back legs underlying said seat.

28. The nested stack of claim 27, further including a skirt extending from the edges of said seat along the sides of said chair and attached to said rectangular frame.

29. The nested stack of claim 28, further including said back having a portion attached to said rectangular frame.

30. The nested stack of claim 20, wherein said opening is of sufficient size to accommodate at least three sets of back legs from three stackable arm chairs.

31. The nested stack of claim 20, wherein said cushion has a portion substantially occupying said opening.

32. A stackable arm chair comprising a frame forming a seat, a back, a pair of front legs, a pair of back legs and a pair of side arms; a side wall extending between said seat and each of said side arms, said side wall arranged at an angle extending upwardly and outwardly from said seat, each of said side walls having an opening less than about 5 inches in height adjacent said seat and a corresponding one of said back legs, said opening extending in a horizontal and vertical plane to allow passage of said back legs therethrough, said opening being substantially coverable by a seat cushion adapted to be positioned on said seat between said side arms, said opening being of sufficient size and location to permit passage therethrough of a corresponding back leg of another stackable arm chair of substantially the same construction for arranging said chairs in a nested stack thereof.

33. The stackable arm chair of claim 32, wherein said opening is less than about 4.5 inches in height.

34. The stackable arm chair as claimed in claim 32, wherein said opening is less than about 3.5 inches in height.

35. The stackable arm chair as claimed in claim 32, further including a seat cushion.

* * * * *

UNITED STATES PATENT AND TRADEMARK OFFICE

CERTIFICATE OF CORRECTION

PATENT NO. : 5,803,540

DATED : September 8, 1998

INVENTOR(S) : Schwartz

It is certified that error appears in the above-identified patent and that said Letters Patent is hereby corrected as shown below:

Column 13, line 66, "placed" should read --spaced--.

Signed and Sealed this

Fifteenth Day of December, 1998

Bruce Lehman

*Attest:*

BRUCE LEHMAN

*Attesting Officer*

*Commissioner of Patents and Trademarks*